US007465904B2

(12) United States Patent
Kim et al.

(10) Patent No.: US 7,465,904 B2
(45) Date of Patent: Dec. 16, 2008

(54) PORTABLE HAIR IRON UTILIZING ANIONS AND MOISTURE TO STRENGTHEN AND REDUCE DAMAGE TO HAIR

(75) Inventors: Tai Cheul Kim, Seoul (KR); Hyun Jin Kim, Seoul (KR)

(73) Assignee: K.I.C.A. Inc., Seoul (KR)

( * ) Notice: Subject to any disclaimer, the term of this patent is extended or adjusted under 35 U.S.C. 154(b) by 0 days.

(21) Appl. No.: 11/263,205

(22) Filed: Oct. 31, 2005

(65) Prior Publication Data

US 2006/0108344 A1 May 25, 2006

(30) Foreign Application Priority Data

Nov. 1, 2004 (KR) ..... 10-2004-0087906
Mar. 23, 2005 (KR) ..... 10-2005-0024189

(51) Int. Cl.
*A45D 1/04* (2006.01)

(52) U.S. Cl. ..... 219/222; 132/229; 132/228; 392/379

(58) Field of Classification Search ..... 219/222, 219/225; 132/224, 225, 228; 392/379, 374, 392/581.2; 239/581.2
See application file for complete search history.

(56) References Cited

U.S. PATENT DOCUMENTS 4,316,077 A * 2/1982 Carlson ..... 392/379
4,341,229 A 7/1982 Bauer et al.
4,490,602 A * 12/1984 Ishihara ..... 392/379
4,525,623 A * 6/1985 Da Silva ..... 392/379
5,091,630 A * 2/1992 Djuric ..... 219/222
5,124,532 A * 6/1992 Hafey et al. ..... 219/200
5,494,058 A * 2/1996 Chan ..... 132/228
5,781,691 A * 7/1998 Kwok ..... 392/405
5,913,315 A 6/1999 Todd
6,029,677 A * 2/2000 Nanba et al. ..... 132/225
6,038,782 A * 3/2000 Schepisi ..... 34/97

(Continued)

FOREIGN PATENT DOCUMENTS

CN 2496296 Y 6/2002

(Continued)

*Primary Examiner*—Tu Hoang
*Assistant Examiner*—Stephen J Ralis
(74) *Attorney, Agent, or Firm*—Pate Pierce & Baird

(57) ABSTRACT

The present invention relates to a hair iron adapted to reduce hair damage, strengthen hair and facilitate hair styling by blowing air toward the hair. The hair iron of the present invention is further adapted to provide hair with anions or moisture during hair styling. The hair iron includes a pair of cases hinge-jointed at each one end and being freely opened or closed, wherein each case has a heater plate for generating heat at the other end. A fan assembly for blowing air is coupled to the one end of one of the cases. An air passage through which the blown air is passed is formed inside the hair iron. An anion generator is located in the fan assembly, thereby mixing the anions with the air being transferred. Means for providing moisture is disposed adjacent to the heater plate and means for supplying the moisture-providing means with water is received in the recess formed in lower side of the case. Further, the present invention relates to a hair iron constructed without a power cord so as to be utilized without any spatial restriction while possessing all the functions of the hair iron.

11 Claims, 27 Drawing Sheets

U.S. PATENT DOCUMENTS

| | | | | |
|---|---|---|---|---|
| 6,223,753 | B1 | 5/2001 | Lo | |
| 6,653,599 | B2 * | 11/2003 | Nam | 219/222 |
| 6,941,955 | B2 * | 9/2005 | Yao | 132/225 |
| 2003/0055469 | A1 * | 3/2003 | Ohmura | 607/96 |
| 2004/0000319 | A1 * | 1/2004 | Carballada et al. | 132/224 |
| 2004/0129288 | A1 * | 7/2004 | Saida et al. | 132/228 |
| 2005/0224091 | A1 * | 10/2005 | Cafaro et al. | 132/228 |

FOREIGN PATENT DOCUMENTS

| | | | |
|---|---|---|---|
| DE | 201 19863 | | 4/2003 |
| JP | 50-132279 | | 10/1975 |
| JP | 55-53001 | | 4/1980 |
| JP | 55-96107 | | 7/1980 |
| JP | 61-124201 | | 8/1986 |
| JP | 06-38829 | | 2/1994 |
| JP | 52-104483 | | 8/1997 |
| JP | 3068706 | | 2/2000 |
| JP | 2003310339 | A * | 11/2003 |
| JP | 2004-249122 | | 9/2004 |
| JP | 2004-267787 | | 9/2004 |
| JP | 2005087629 | A * | 4/2005 |
| KR | 20-0270330 | | 4/2002 |
| KR | 20-0304059 | | 2/2003 |
| KR | 20-0338792 | | 1/2004 |
| KR | 20-0341775 | | 2/2004 |
| KR | 20-0346007 | | 3/2004 |
| WO | WO 9409669 | A1 * | 5/1994 |
| WO | WO 03/007702 | | 9/2003 |

* cited by examiner

PORTABLE HAIR IRON UTILIZING ANIONS AND MOISTURE TO STRENGTHEN AND REDUCE DAMAGE TO HAIR

This application claims benefit of priority under 35 U.S.C. § 119 to Korean Patent Application Nos. 10-2005-24189 filed Mar. 23, 2005 and 10-2004-87906 filed Nov. 1, 2004, which are incorporated herein by reference.

FIELD OF THE INVENTION

The present invention generally relates to hair irons, and more particularly to a hair iron adapted to reduce hair damage, strengthen hair and facilitate hairstyling by blowing air toward the hair and providing anions or moisture during hairstyling. Further, the present invention relates to a hair iron that does not utilize a power cord, thereby being capable of being used without any spatial restriction while providing all the functions of the hair iron.

BACKGROUND OF THE INVENTION

Typically, hair irons are used to style hair through converting electric energy into heat energy of 60° C. to 210° C., which is then applied to the hair. Such hair irons generally include a pair of cases, which are hinge-jointed at each end, so as to be opened and closed within a certain degree of angle. Further, heater portions, which can generate heat that is applied to the hair, are provided at the inner opposing sides of the cases.

Korean Utility-Model Registration Publication No. 20-0270330 discloses an iron used for a permanent wave. In forming the permanent wave with such iron, the heat generated from the iron is uniformly applied to the hair, which is wound around the lots. This is so that the permanent wave may be formed rapidly in a shorter amount of time without damaging the hair.

Korean Utility-Model Registration Publication No. 20-0304059 discloses a hair iron, wherein the joint lines of the hair iron are not exposed externally. This increases the aesthetic appearance and reliability of the hair iron, while facilitating the assembly of the same.

Korean Utility-Model Registration Publication No. 20-0338792 discloses a hair iron with comb-teeth. Such configuration allows the hair iron to be more conveniently used, while allowing greater heat transfer so as to produce glossy and elastic hair.

Korean Utility-Model Registration Publication No. 20-0341775 discloses a hair iron having vibrating heater plates. Through the use of the vibrating heater plates, the iron is configured to mitigate hair damage and facilitate hair styling.

Korean Utility-Model Registration Publication No. 20-0346007 discloses a hair iron, comprising the following: a pair of plates facing each other, wherein the opening distance therebetween is adjustable; knobs for adjusting the opening distance, wherein the knobs are coupled to the plates; and a switch provided on one of the knobs, wherein the switch is configured to open and break electric power supplied to the plates. The hair iron further comprises hot wires containing carbon component and located on the opposed sides of the plates, wherein the hot wires supplied with the electric power generate and transfer the heat directly to the hair. Also, the hair iron includes an insulating member having heat-resistive and heat-insulating functions, wherein such member is disposed between the hot wires and the plates.

However, the above-described prior art hair irons are inefficient and undesirable for purposes of hair styling in that they lack the proper functions and structures to carry out the same.

Further, since the aforementioned prior art hair irons can style the hair only with heat, the time required for hair styling may cause the hair to be damaged. This is because the hair is typically subjected to the heat generated from the hair iron for a prolonged amount of time.

In addition, the aforementioned prior art hair irons can be utilized only near the source providing the necessary power thereto. Thus, they can be used only near the power source.

SUMMARY OF THE INVENTION

Therefore, it is an object of the present invention to provide a hair iron, which can reduce the time of hair styling, prevent hair damage and strengthen hair. Specifically, the hair iron of the present invention can facilitate hair styling by optionally supplying the hair and scalp with air, anions or steam when applying heat during hair styling.

It is another object of the present invention to provide a hair iron, which does not require a power cord to obtain the necessary power so as to be utilized without any spatial restriction while having the functions of the hair iron.

Consistent with the foregoing objects and in accordance with the invention as embodied broadly herein, there is provided a hair iron comprising: a pair of cases hinge-jointed at their respective ends and being freely opened and closed; heater plates mounted to sides facing each other of the cases for generating heat; a fan assembly coupled to the cases for blowing air toward the heater plates; supporting members formed with a plurality of air-ejecting holes, each supporting member being disposed between one of the cases and one of the heater plates to support the heater plate; and an air passage for transferring the air blown from the fan assembly to the air-ejecting holes.

Further, it is preferred that the fan assembly includes a housing having air inlets through which external air flows in and air outlets communicating with the air passage. It is further preferred that a fan is contained inside the housing.

Further, it is preferred that the air passage includes grooves formed along both side edges of the case.

In the present invention, it is preferred that the hair iron further comprises means for opening and closing the air passage, wherein the opening and closing means is mounted to at least one of the side edges of the case.

It is also preferred that the opening and closing means includes a blocking plate configured to block the air passage. It is further preferred that there is a lever for turning the blocking plate.

Further, it is preferred that the hair iron further comprises a means for controlling the volume of air ejected from the air-ejecting holes of the supporting member, wherein the controlling means is removably engaged with the supporting member.

In the present invention, the controlling means preferably includes a bar closing the air-ejecting holes.

It is also preferred that the bar includes at least one air outlet communicating with the air-ejecting holes. Also, the bar should preferably have a plurality of comb-teeth.

Further, it is preferred that the hair iron further comprises an anion generator for providing anions into the air being transferred.

Further, it is preferred that the heater plates are in contact with each other throughout the opposed surfaces thereof, wherein the contacting surfaces are inclined widthwise.

Further, it is preferred that the hair iron further comprises means for providing hair with moisture and means for supplying the moisture-providing means with water.

The moisture-providing means preferably includes a steam-generating plate disposed between the heater plate and the supporting member. Preferably, there are steam-ejecting holes, which are formed on one side of the steam-generating plate, so as to communicate with the air passage.

Further, the water-supplying means preferably includes a water container, wherein the water container preferably has an ejection nozzle for ejecting the stored water. Preferably, there is further provided a pressure-applying member for applying pressure to the stored water so as to discharge the stored water.

It is also preferred that the pressure-applying member is made of silicone.

It is also preferred that a recess for receiving the water container is formed on the outer surface of the case. Further, there are preferably formed in the recess a connection hole into which the ejection nozzle is fitted, a sealing member for sealing the ejection nozzle and the connection hole, and a pressing protrusion for pressing the pressure-applying member. If the water container is received in the recess and pressed down toward the case, then the pressing protrusion presses the pressure-applying member so that the water inside the water container is ejected.

It is further preferred that the sealing member is made of silicone.

Further, it is preferred that a battery holder having at least one battery for supplying the hair iron with an electric power is installed in one of the cases.

In the present invention, it is preferred that the battery is rechargeable and a jack configured to be connected with an external power source for charging the battery is provided at the case.

BRIEF DESCRIPTION OF DRAWINGS

The above object and features of the present invention will become more apparent from the following description of the preferred embodiments given in conjunction with the accompanying drawings.

DETAILED DESCRIPTION OF THE PRESENT INVENTION

The preferred embodiments of the present invention will now be described with reference to the accompanying drawings. Herein, the terms "front" and "rear" mean a direction going away from a hinge shaft along a hair iron and a direction facing toward the hinge shaft along the hair iron, respectively. Further, the terms "inner" and "outer" mean a direction facing toward the inside of the hair iron and a direction facing toward the outside of the hair iron, respectively.

Figure 1:
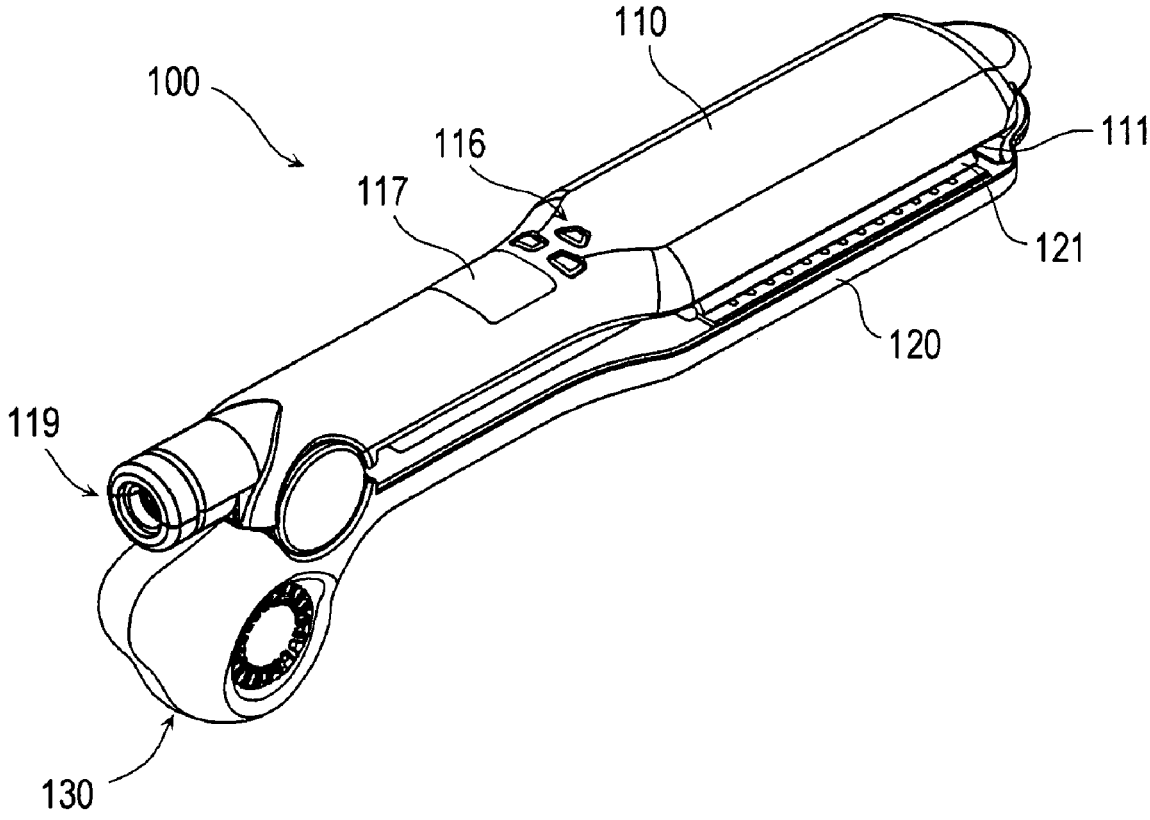
FIG. 1 is a perspective view illustrating a hair iron in accordance with a preferred embodiment of the present invention.
Figure 2:
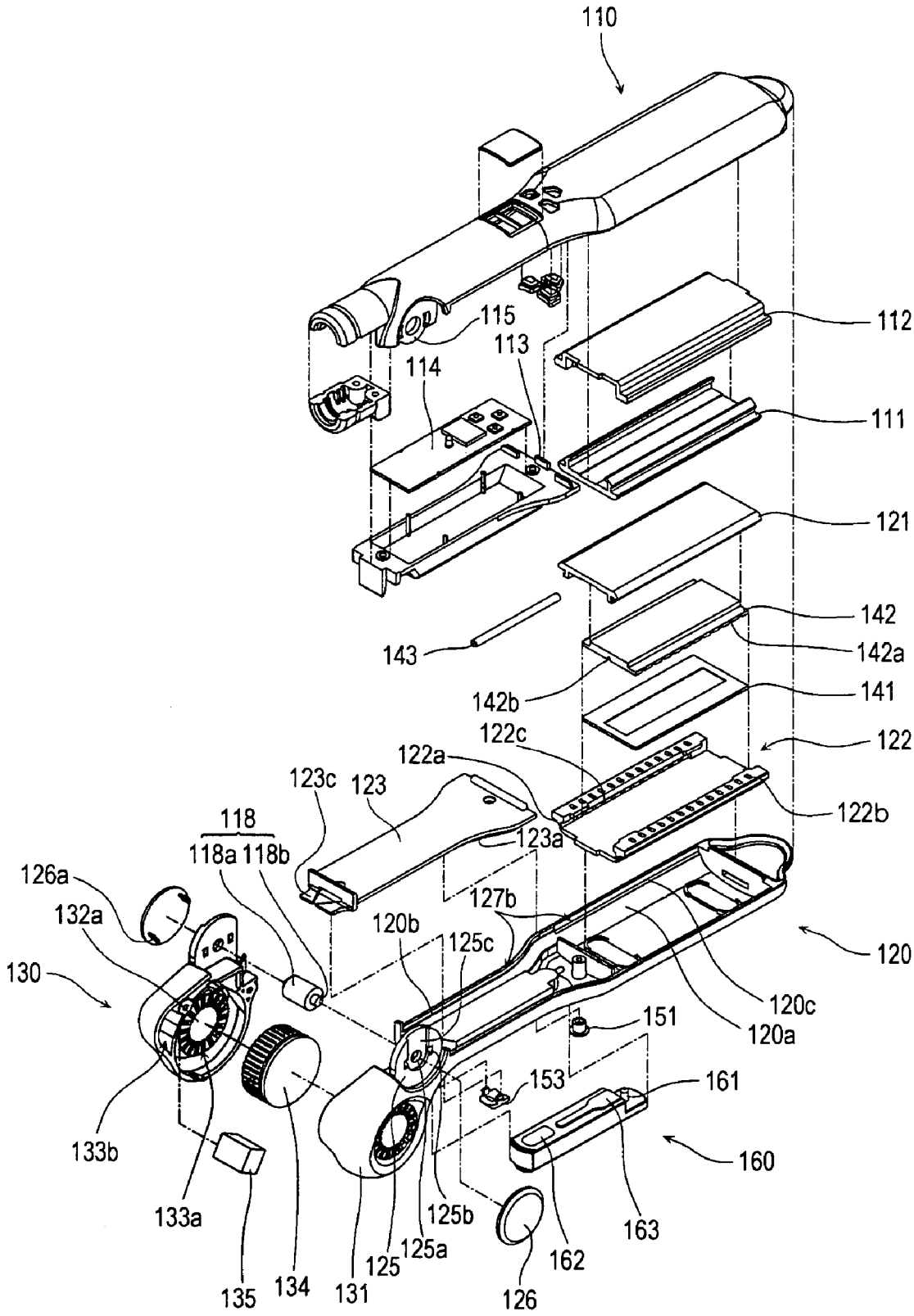
FIGS. 2 and 3 are exploded perspective views of the hair iron illustrated in FIG. 1.
Figure 3:
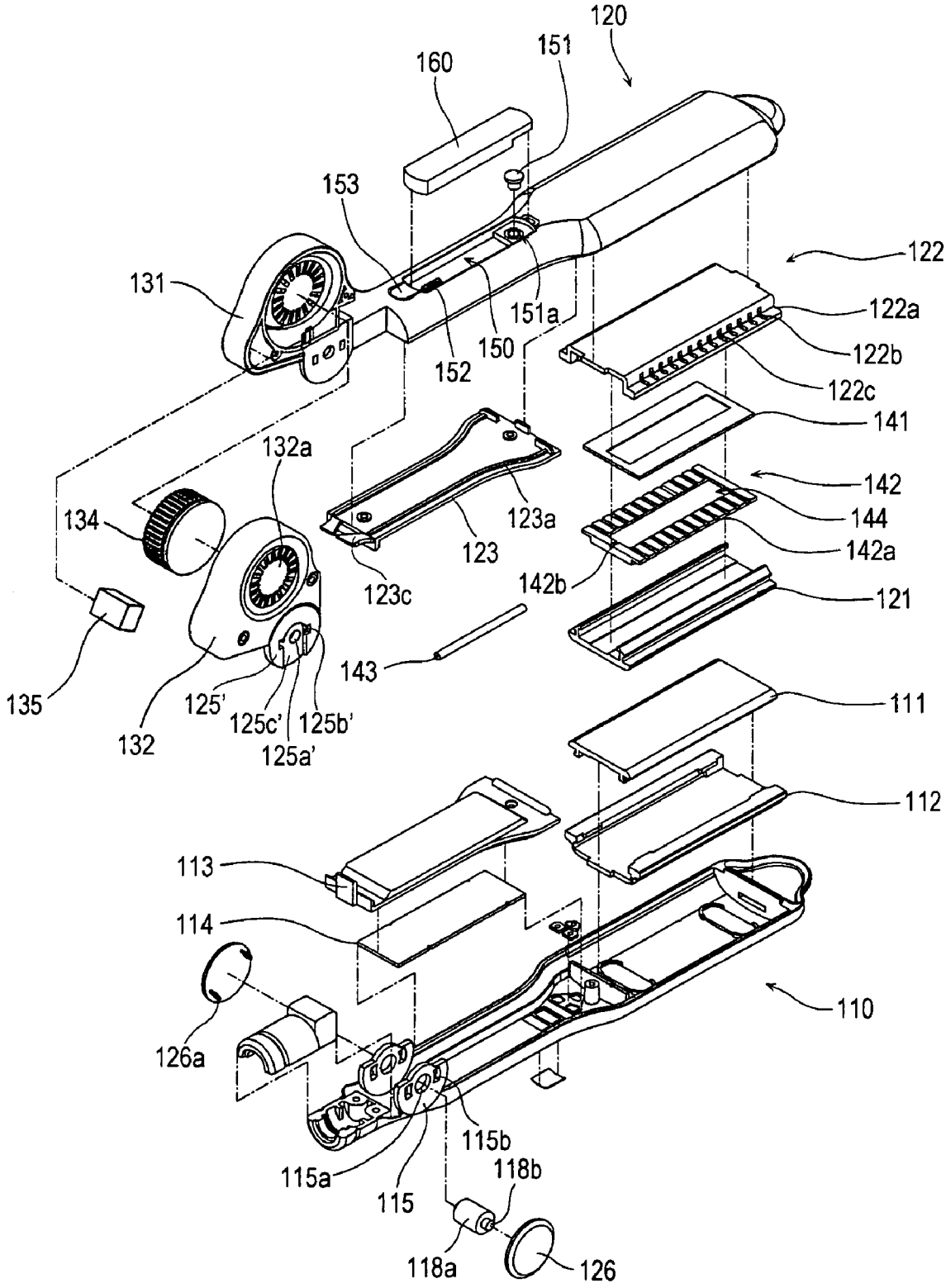

FIG. 1 is a perspective view illustrating a hair iron 100 constructed in accordance with a preferred embodiment of the present invention. FIGS. 2 and 3 are exploded perspective views of the hair iron 100.

Referring to FIGS. 1 to 3, the hair iron 100, which is constructed in accordance with a preferred embodiment of the present invention, comprises: a pair of cases 110 and 120 hinge-jointed at their respective ends and being freely opened or closed; heater plates 111 and 121 respectively mounted to the sides, which face each other, of the cases for generating heat; a fan assembly 130 coupled to the end of one 120 of the cases for blowing air toward the heater plates; supporting members 112 and 122 formed with a plurality of air-ejecting holes, wherein each supporting member is disposed between one of the cases 110 and 120 and one of the heater plates 111 and 121 to support the heater plates 111 and 121; and an air passage 127*a* and 127*b* for transferring the air blown from the fan assembly 130 to the air-ejecting holes 122*b*.

The upper case 110 has a receiving space opened toward the lower case 120. The upper heater plate 111, the upper supporting member 112, the upper cover member 113, and a printed circuit board 114 are mounted in the receiving space.

As shown in FIG. 1, the following is provided on the upper case 110: a switch part 116 for operating the hair iron 100; a display part 117 such as a LCD for displaying the operating states of the hair iron 100; and a connector 119 through which a power cord for connection with the external power source may be connected to the upper case 110.

The upper heater plate 111, which contacts and applies heat to the hair, is disposed in the receiving space of the other end of the upper case 110. Also, the lower heater plate 121 is disposed in a receiving space of the other end of the lower case 120. Those heater plates 111 and 121 include heaters. Each heater is supplied with an electric power and generates heat. The heater may be a plate type, a coil type, etc.

In order to fix the upper heater plate 111 to the upper case 111, the upper supporting member 112 is disposed between the upper heater plate 111 and the inside of the upper case 110. The upper supporting member 112 supports the upper heater plate 111 with respect to the upper case 110 such that the upper heater plate 111 can be exposed externally by a constant elevation. Further, the upper supporting member 112 can also insulate the heat generated from the upper heater plate 111 so as to minimize the heat transfer toward the upper case 110.

The upper cover member 113 is engaged with the upper case 110 between the upper supporting member 112 and one end of the upper case 110. The upper cover member 113 covers the inside of the upper case 110 uncovered by the upper supporting member 112. Thus, it hides the inside of the upper case 110 and protects the components disposed inside the upper case 110.

The printed circuit board (PCB) 114, on which various elements for controlling the operation of the hair iron 100 are mounted, is disposed between the upper cover member 113 and the upper case 110. The PCB 114 is connected to an external power source through the connector 119. The PCB 114 includes: a circuit for controlling an electric power supplied to the heater plates 111 and 121 and displaying the operating states of the hair iron 100; and a circuit for controlling an electric power supplied to a fan 134 and an anion generator 135, which are described hereinafter, and displaying their operating states.

At the one end of the upper case 110, two plate-like hinge portions 115 are extended toward the lower case 120 so as to be joined to the lower case 120. The through-holes 115*a*, into which the body 118*a* of a hinge shaft 118 is fitted, are formed at the same elevation in each hinge portion 115. Further, two catch holes 115*b*, in which two hooks 126*a* of a hinge cap 126 are caught, are formed near the through-hole 115*a*. The hinge portions 115 are positioned inside the outer surface of the upper case 110. Thus, when the upper and lower cases 110 and 120 are joined together, the lateral sides of the hair iron 100 do not protrude out as much.

As shown in the figures, the lower case 120, which makes a pair and is joined to the upper case 110 so as to be opened and closed about the hinge shaft 118, has a receiving space opened toward the upper case 110. The lower heater plate 121, the lower supporting member 122 and the lower cover member 123 are disposed in the receiving space, whereby air passages 127*a* and 127*b* may be formed.

The one end of the lower case 120 is formed with a hinge portion 125 extended toward the upper case 110. The hinge portion 125 has a through-hole 125*a* into which the bearing protrusion 118*b* of the hinge shaft 118 is fitted. It also comprises two through-holes 125*b* through which the hooks 126*a* of the hinge cap 126 are passed respectively near the through-hole 125*a*. Also, the upper side of the second housing 132 of the fan assembly 130, which is described hereinafter, is formed with a corresponding hinge portion 125'. The hinge portion 125' has through-holes 125*a'* and 125*b'* corresponding to through-holes 125*a* and 125*b*, respectively. Since the hinge portions 125 and 125' are positioned so as to cooperate with the hinge portions 115 of the upper case 115, the upper and lower cases 110 and 120 can be joined together so as to be freely opened and closed about the hinge shaft 118.

Specifically, when the body 118*a* of the hinge shaft 118 is fitted into the through-holes 115*a* of the upper case 110, the bearing protrusions 118*b* are fitted into the through-hole 125*a* of the hinge portion 125 and through-hole 125*a'* of the hinge portion 125'. Thus, the upper case 110 and the lower case 120 are joined together so as to be freely opened and closed about the hinge shaft 118. In such a case, the hinge shaft body 118*a* has a diameter, which is sufficient enough to be inserted into the through-holes 115*a*. Further, the bearing protrusion 118*b* has a diameter that is sufficient enough to be inserted into the through-hole 125*a* and 125*a'*. The hinge cap 126 is then fixed through the through-holes 125*b* and the catch holes 115*b*.

Further, the hinge portions 125 and 125' have grooves 125*c* and 125*c'*, respectively. After the upper and lower cases 110 and 120 are joined together, a portion of the bearing protrusion 118*b* can be exposed to the outside through the through-hole 125*a*. In such a case, the one end of the bearing protrusion 118*b* may be provided with a groove (not shown) into which a fastening means such as an E-shaped snap ring can be fitted so as to ensure the fixing of the hinge shaft 118. Such fastening may be done on the grooves 125*c* and 125*c'*.

Similar to the upper case 110, the lower heater plate 121 is disposed in the receiving space of the other end of the lower case 120 and the lower supporting member 122 is engaged with the lower case 120 so as to fix the heater plate 121 to the lower case 120. Also, similar to the upper cover member 113, the lower cover member 123 is engaged with the lower case 120 between the lower supporting member 122 and the one end of the lower case 120. This is so that the inside of the lower case 120 uncovered by the lower supporting member 122 may be covered and hid.

In the present embodiment, while the upper and lower cover members 113 and 123 are formed separately and engaged with the respective cases 110 and 120, the cover members may be integrally incorporated in the cases 110 and 120. In such a case, air passages may be formed accordingly.

According to the above constitution, an electric power is supplied to the heaters included in the heater plates 111 and 121 from an external power source via the PCB 114 and the heat required to style the hair is generated from the heaters. Accordingly, the user opens the upper and lower cases 110 and 120, places the hair between the heater plates 111 and 121 provided at the other ends of the upper and lower cases 110 and 120, closes the opened cases 110 and 120, and then performs hair-styling. By doing so, the hair can be waved and curled by means of the motion of turning or pulling out the hair iron 100.

When styling hair, there is a need to form the hair in a desired shape or dry the hair. When the hair is styled only with the heat generated from the heater plates 111 and 121, it may take long to style the hair, which may result in hair damage. Accordingly, if air is blown toward the hair so as to reduce the time required to dry the hair or to prevent the hair from being overheated, the above problems can be avoided. To this end, the hair iron 100, which is constructed in accordance with the preferred embodiment of the present invention, comprises a fan assembly 130. The fan assembly 130 is arranged adjacent to the one end of the lower case 120 and blows air toward the heater plates 111 and 121.

Figure 4:
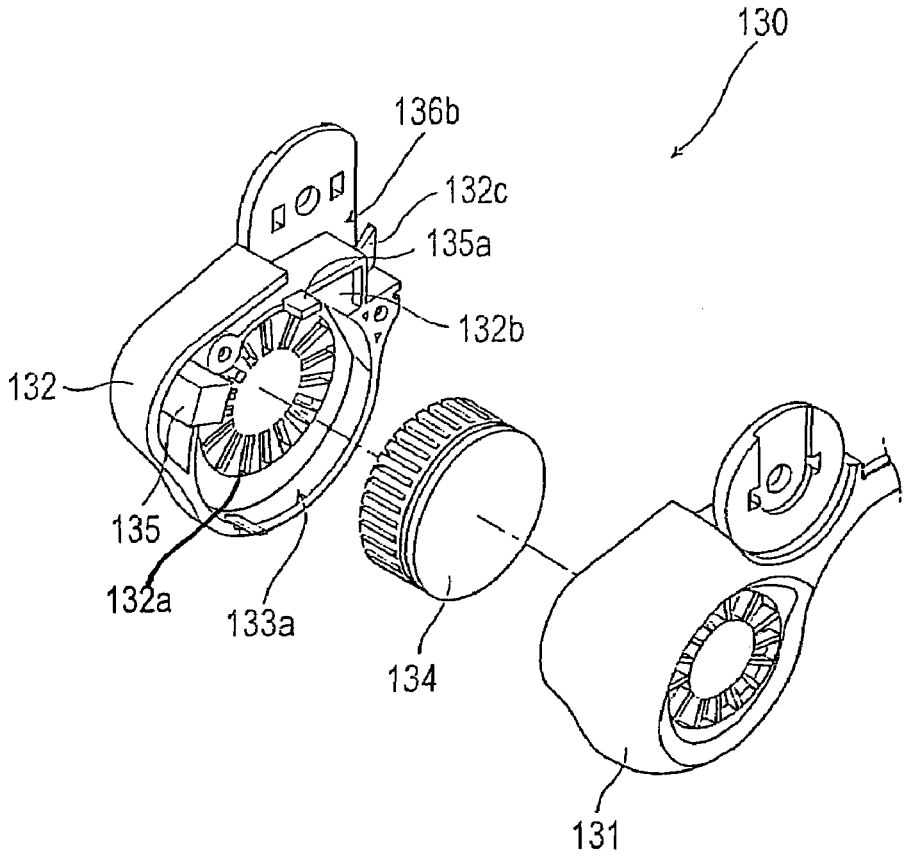
FIG. 4 is an exploded perspective view of a fan assembly.

FIG. 4 is an exploded perspective view of the fan assembly 130. The fan assembly 130 includes: first and second housings 131 and 132 coupled to each other and forming an exterior appearance; and a fan 134 for blowing air, which is contained in the space between the housings.

The first housing 131 is extended from the one end of the lower case 120. The second housing 132 is coupled to the first housing 131, thereby forming the exterior appearance of the fan assembly 130. The fan 134 is arranged between the housings 131 and 132 and blows air. While a part of the fan assembly 130 in the embodiment is integrally incorporated in the one end of the lower case 120, it will be appreciated that the fan assembly 130 may be manufactured as an individual unit and coupled to the upper case 110 or the lower case 120. Also, it will be appreciated that the fan assembly 130 may be arranged at the one end of the upper case 110. In such a case, the components related to an air blow may be positioned differently.

The fan 134 is operated by driving means such as an electric motor (not shown). The fan 134 causes the air to be blown toward the heater plate 121 by air intake through inlets 132*a* and discharging air out of the fan assembly 130. In FIG. 4, the fan 134 blows air while rotating clockwise and the air forced by the fan 134 is discharged from the discharge port 136*b* of the fan assembly 130.

Figure 5:
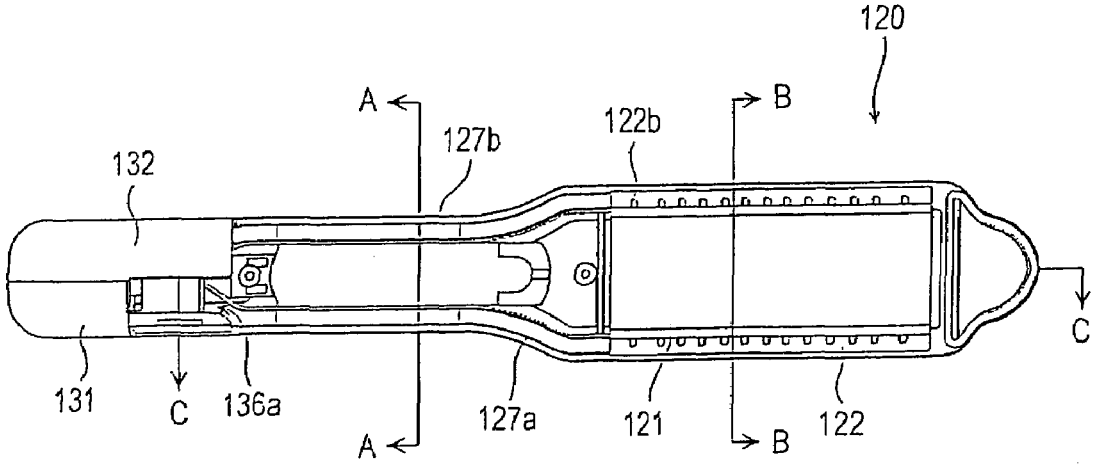
FIG. 5 is a plan view of a lower case of the hair iron with a lower cover member removed.

In FIG. 4, it is illustrated that the discharge port 136*b* is merely formed in the second housing 132 side. However, the first housing 131 side also has a discharge port 136*a* (see FIG. 5). The discharge port 136*b* can be defined by a discharge port floor 132*b*, a diverging plate 132*c* provided in the second housing 132 and a discharge port cover 123*c* provided in the rear portion of the lower cover member 123. The discharge port 135*a* provided in the first housing 131 side is formed in the same manner as the discharge port 136*a*. Accordingly, it will be appreciated that the air discharged from the fan assembly 130 is transferred as diverged into the both sides of the lower case 120. The air discharged out of the discharge ports 136*a* and 136*b* is blown toward the heater plate 121 via the air passages 127*a* and 127*b*, which are described below.

Since hair styling is a process involving application of heat to the hair and transforming hair into desired styles, the hair can become damaged due to the heat applied during the process. In this regard, the hair iron 100, which is constructed in accordance with the preferred embodiment of the present invention, further comprises an anion generator 135 in order to cure the damaged hair, improve the moisturizing of the hair and prevent the crumbliness of the hair.

The anion generator 135 in the present embodiment is located near the fan 134 and arranged in an isolated space 133*b* in the fan assembly 130. The anion generating portion 135*a* extended from the anion generator 135 is positioned in close proximity to the discharge ports 136*a* and 136*b*. Accordingly, the generated anions are mixed into the air flowing to the discharge port 136*a* and 136*b*, transferred toward the heater plate 121 with the air, and reach the hair or the scalp.

The air discharged from the discharge ports 136*a* and 136*b* of the fan assembly 130 moves along the air passages 127*a* and 127*b* and is blown to the hair through the air-ejecting holes 122*b* formed in the lower supporting member 122. The air passages 127*a* and 127*b*, through which the air forced by the fan 134 passes, are shown in detail in FIGS. 5 to 7. The air passages 127*a* and 127*b* in the present embodiment is constructed in the form of grooves formed continuously along the both side edges of the lower cases 120. Specifically, one part of the air passages is formed by the inner wall of the lower case 120 and the outer wall of the lower cover member 123, while the other part of the air passages is formed by the inner wall of the lower case 120 and the outer wall of the lower supporting member 122.

Figure 6:
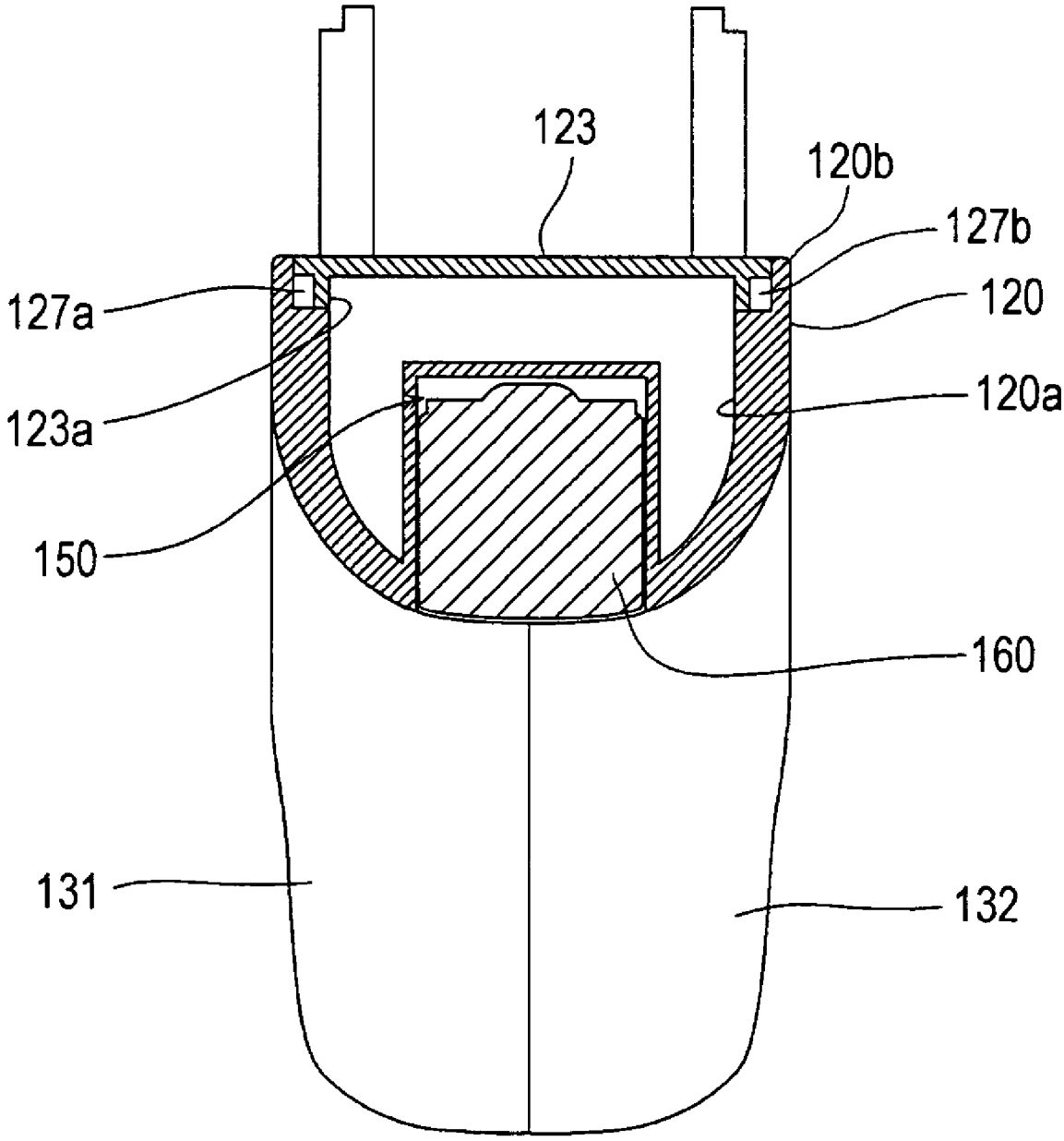
FIG. 6 is a cross-sectional view along the line A-A in FIG. 5.

The one part of the air passages 127*a* and 127*b*, which is formed by the inner wall of the lower case 120 and the outer wall of the lower cover member 123, is shown in FIG. 6. Referring to FIG. 6, stepped portions 120*b* are formed on the upper portion of the inner wall 120*a* of the lower case 120. The stepped portions 120*b* are formed along both side edges of the lower case 120 in the area where the lower cover member 123 covers the lower case 120. Also, corresponding to the stepped portion 120*b*, barrier rib 123*a* is formed on the surface of the lower cover member 123 facing toward the inside of the lower case 120 and along the side edges of the lower cover member 123 so as to abut the inner wall 120*a*. Thus, as shown in FIG. 6, the one part of the air passages 127*a* and 127*b* is formed, which is defined by the stepped portions 120*b* being a portion of the inner wall 120*a* of the lower case 120 and edges and barrier ribs 123*a* of the lower cover member 123.

Figure 7:
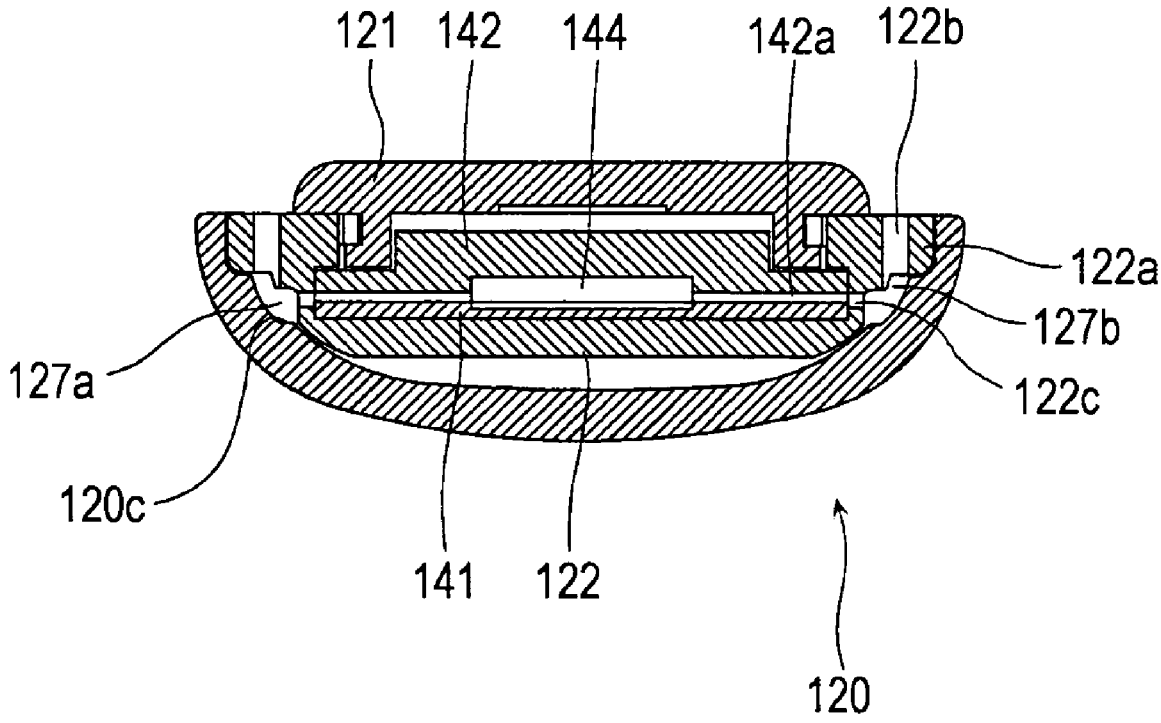
FIG. 7 is a cross-sectional view along the line B-B in FIG. 5.

The other part of the air passages 127*a* and 127*b*, which is formed by the inner wall of the lower case 120 and the outer wall of the lower supporting member 123, is shown in FIG. 7. Both side edges of the lower supporting member 122, which are engaged with the other end of the lower case 120, are provided with extended portions 122*a*, each of which is extended horizontally from respective edges. Also, in the inner wall of the lower case 120 covered by the lower supporting member 122, raised portions 120*c* following the stepped portions 120*b*, which are engaged with the lower portion of the lower supporting member 122 to define the air passages 127*a* and 127*b*, are formed along both side edges of the lower case 120. Thus, as shown in FIG. 7, the inner wall of the lower case 120 having the raised portions 120*c* and the extended portions 122*a* and a portion of the outer wall of the lower supporting member 122 form the other part of the air passages 127*a* and 127*b*.

Air passes through the air passages 127*a* and 127*b*, which are formed in the above manner, and is supplied to the hair through the air-ejection holes 122*b* formed in the extended portions 122*a* of the lower supporting member 122.

Alternatively, a pipe/pipes connecting the discharge ports 136*a* and 136*b* of the fan assembly 130 and the air-ejecting holes 122*b* may be employed instead of the air passage.

Figure 8A:
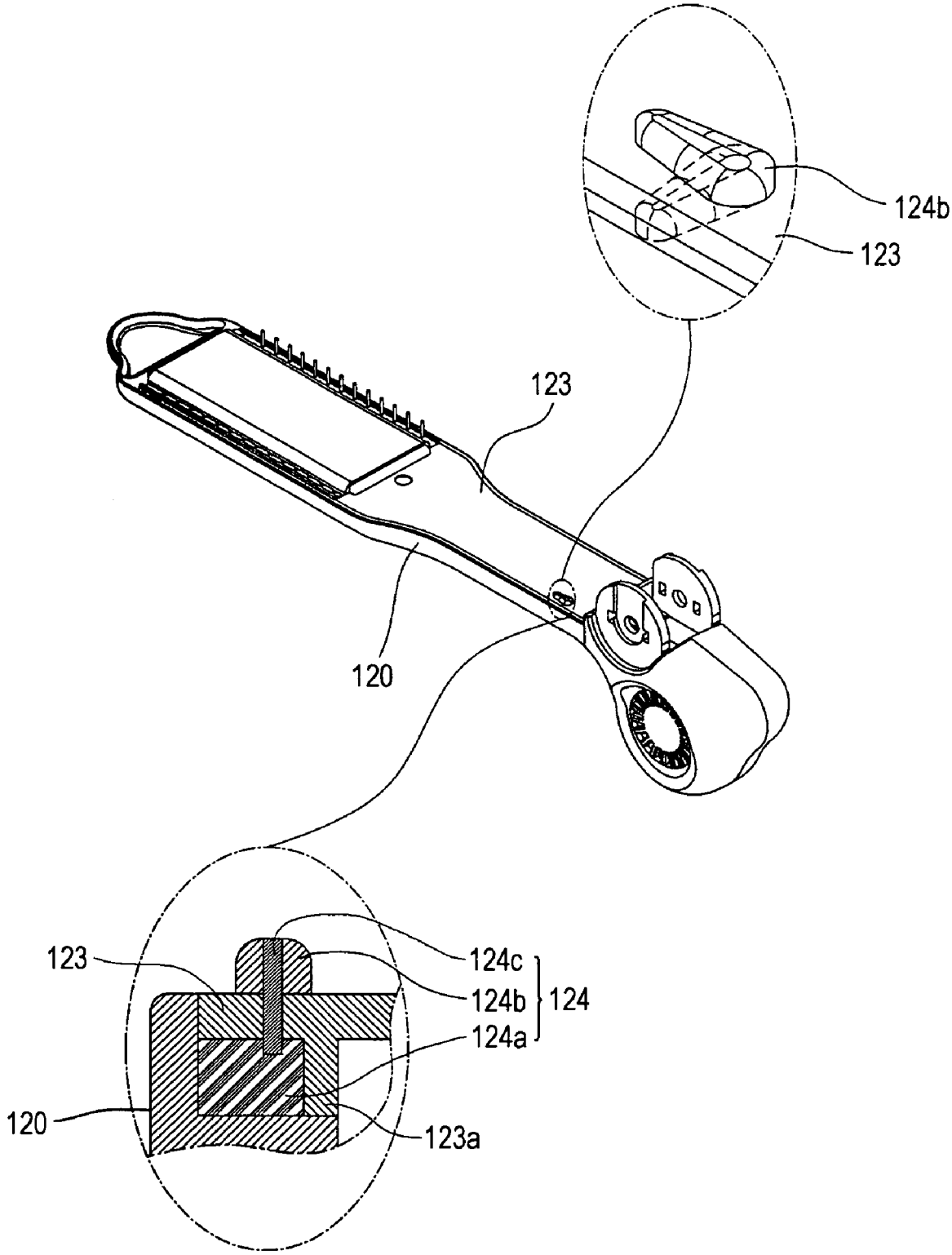
FIG. 8*a* is a partial perspective view showing means for opening and closing the air passage.
Figure 8B:
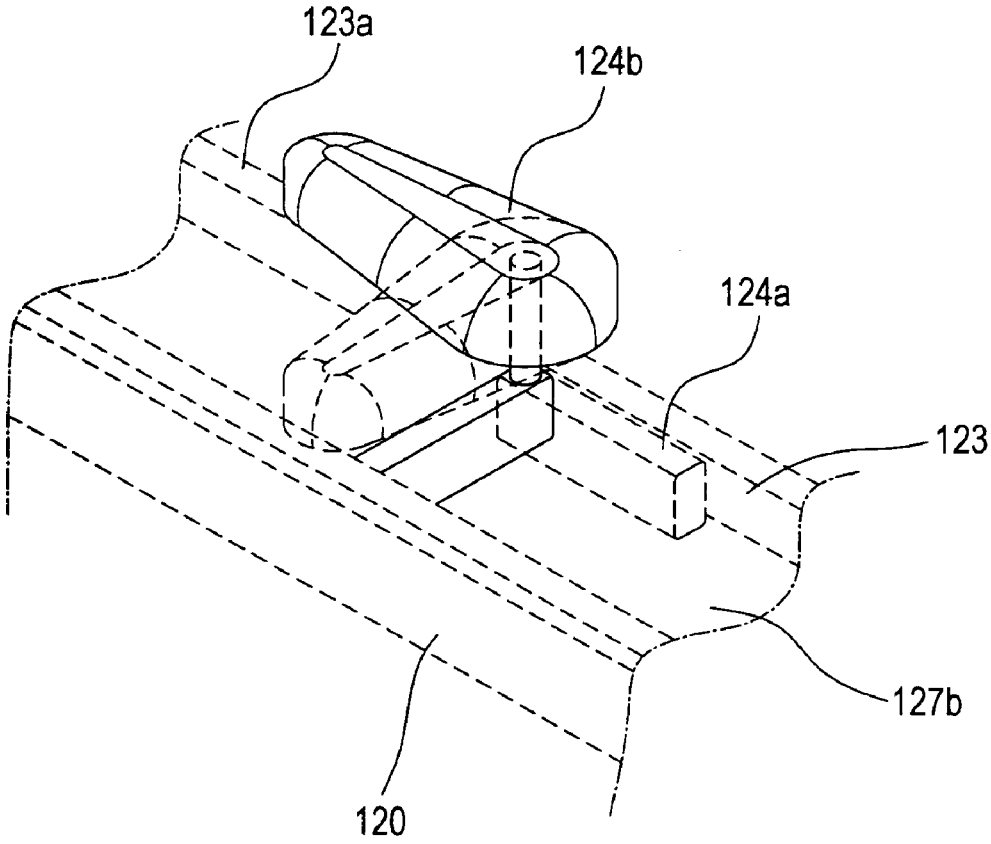
FIG. 8*b* is a partially enlarged perspective view of FIG. 8*a*.

Further, the hair iron 100, which is constructed in accordance with the preferred embodiment of the present invention, further comprises means for opening and closing the air passages 127*a* and 127*b* and controlling the volume of air. Thus, the user operates the opening and closing means 124 to use only one of the air passages or control the volume of air flowing in the air passage. FIGS. 8*a* and 8*b* show the opening and closing means 124 arranged near the air passage 127*b*.

Referring to FIGS. 8*a* and 8*b*, the opening and closing means 124 includes: a blocking plate 124*a* capable of opening and closing the air passage 127*b*; a lever 124*b* for turning the blocking plate 124*a*; and a connecting shaft 124*c* connecting them to each other. As the lever 124*b* is turned, the blocking plate 124*a* is rotated. The blocking plate 124*a* can be rotated between the position of closing the air passage 127*b* and the position of fully opening the air passage 127*b*. Thus, when the blocking plate 124*a* closes the air passage 127*b*, the air is supplied toward the heater plate 121 only through the air passage 127*a*. Also, when the blocking plate 127*a* is opened to some extent, the volume of air passing through the air passage 127*b* is less than that of the air passage 127*a*.

While the opening and closing means 124 is provided on one side of the lower cover member in FIGS. 8*a* and 8*b*, it should be noted that the present invention is not limited thereto. For example, both air passages of the lower cover member 123 may be equipped with the opening and closing means 124. In such a case, it will be appreciated that the air may be blown through only one air passage depending on the choice of the user.

Unlike the mechanical control of the volume of air by means of the opening and closing means 124, the volume of air may be controlled by means of the electrical control. For example, if the PCB 114 includes any circuit capable of varying the rotating speed of the fan 134 arranged in the fan assembly 130 and the user operates the circuit, the volume of air can be controlled by varying the rotating speed of the fan 134.

In this way, air is supplied to the hair disposed between the heater plates 111 and 121, while the user is using the hair iron 100 for hair styling purposes. The air ejected from the air-ejecting holes 122*b* of the lower supporting member 122 is supplied to the hair located between the heater plates 111 and 121 by way of the lower heater plate 121 placed on the lower supporting member 122. Consequently, when using the hair iron 100 in order to dry the hair, the drying time can be shortened. When styling the hair, the setting time can be shortened. Moreover, since anions generated from the anion generator 135 are contained in the air being supplied to the hair, the health and the moisture state of hair become improved.

During hair styling, providing moisture to the hair can facilitate hair styling and enhance moisturizing of hair. In order to provide the hair with moisture, the hair iron 100, which is constructed in accordance with the preferred embodiment of the present invention, further comprises means for providing hair with gaseous moisture and means for supplying the moisture-providing means with water.

Referring back to FIGS. 2 and 3, the moisture-providing means includes: first and second steam-generating plates 141 and 142 disposed between the lower heater plate 121 and the lower supporting member 122; and a plurality of steam-ejecting holes 142*a* formed in both side edges of the steam-generating plate 142 so as to be in communication with the air passages 127*a* and 127*b*. Also, the water-supplying means includes a water container 160, which can store water therein and eject the stored water to the steam-generating plates 141 and 142.

Figure 9:
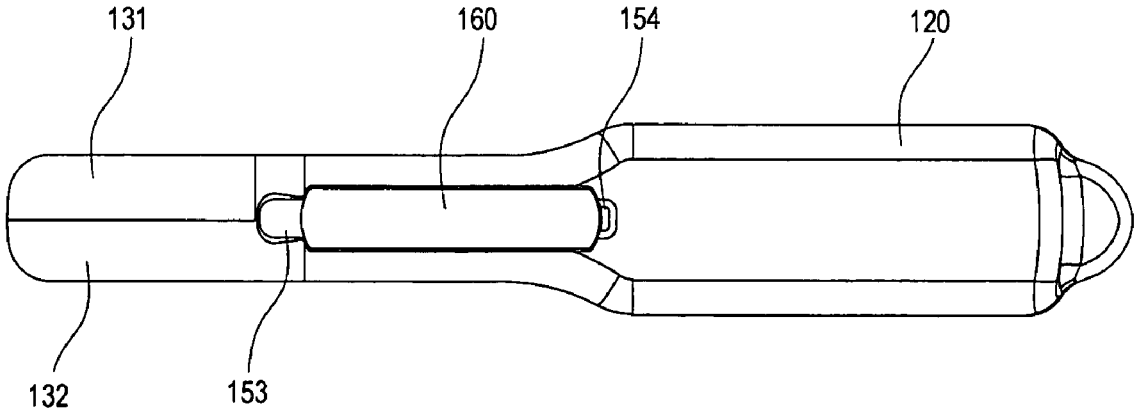
FIG. 9 is a bottom view of the hair iron illustrated in FIG. 1.
Figure 10:
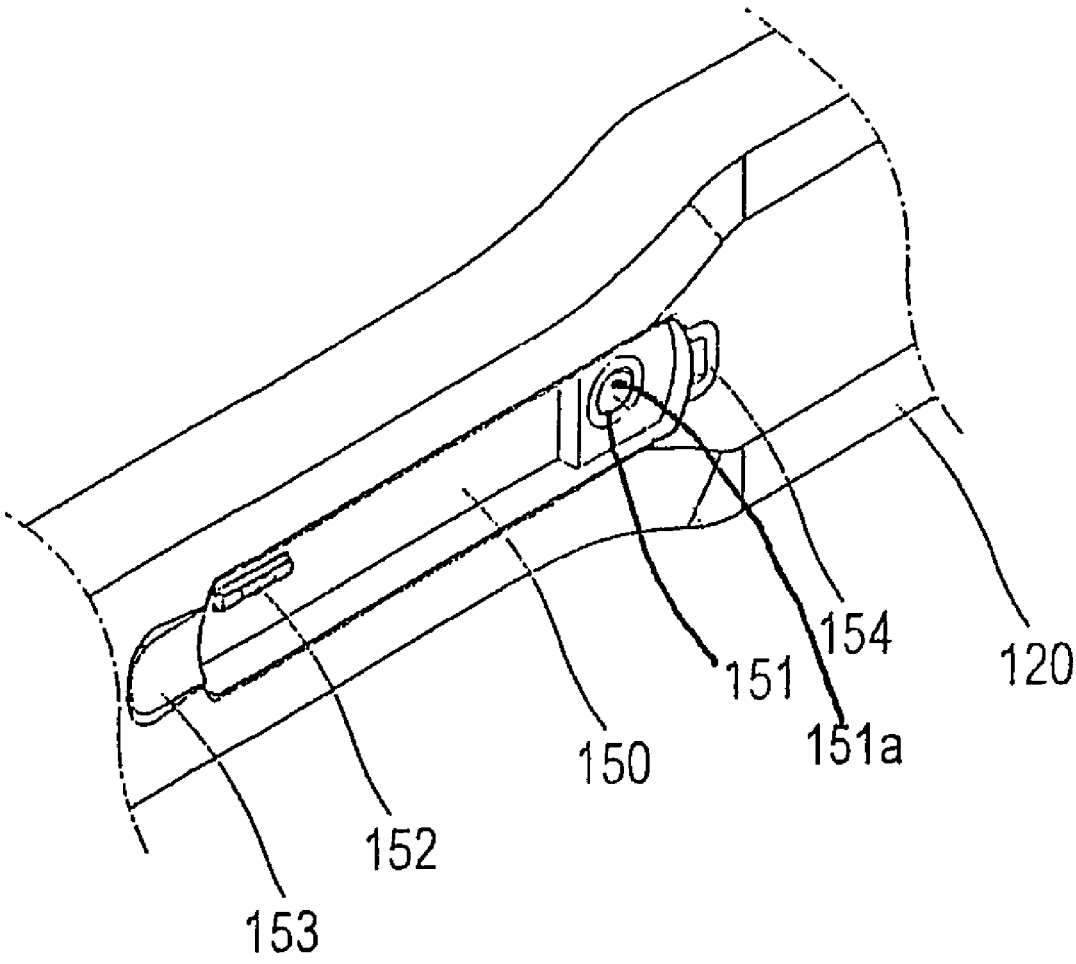
FIG. 10 is a partial perspective view of the lower case with a water container removed.
Figure 11A:
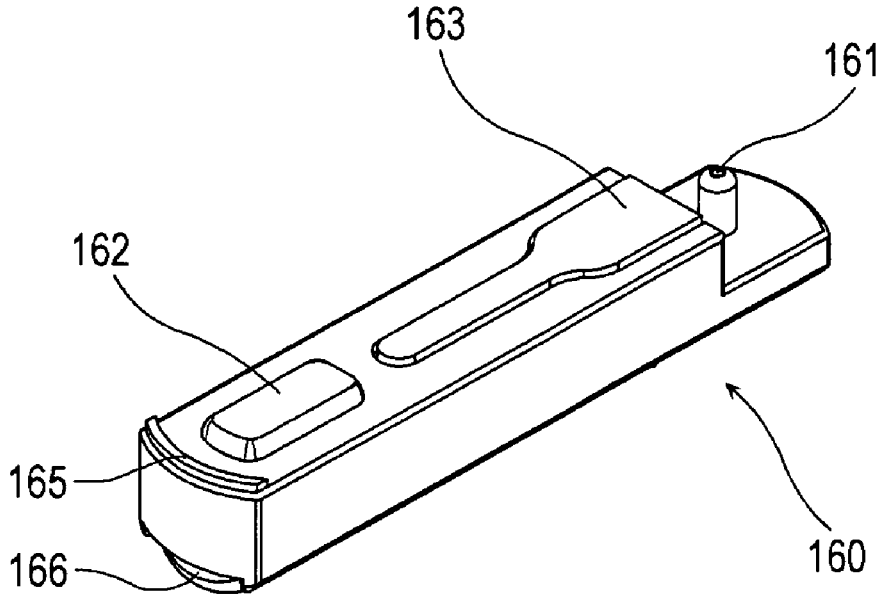
FIGS. 11*a* and 11*b* are perspective views of the water container.
Figure 11B:
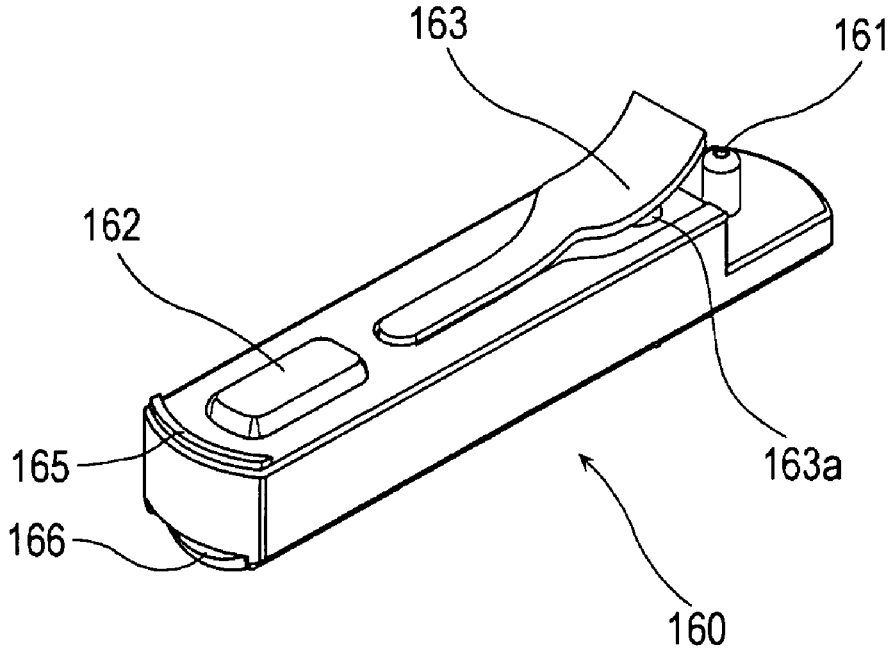

FIG. 9 is a bottom view of the hair iron 100, which illustrates that a water container 160 is removably or releasibly engaged to the lower case 120. FIG. 10 shows a recess 150 in which the water container 160 is received. FIG. 11*a* and FIG. 11*b* are perspective views of the water container 160.

Referring to FIGS. 11*a* and 11*b*, the water container 160 is constructed so as to store water therein. The upper side of the water container 160 is formed with a water inlet 163*a* and provided with a lid 163 for covering and protecting the water inlet 163*a*. Also, the upper rear portion of the water container 160 is provided with a member for applying pressure, which is capable of performing pumping action in order to discharge the water stored inside the water container 160. Further, the front portion of the water container 160 is provided with an ejection nozzle 161, protruding upward from the water container 160, from which the water discharged by the pumping action of the pressure-applying member 162 can be ejected. Also, the front end of the water container 160 is provided with a hook portion (not shown) allowing the water container 160 to be held in the recess 150. At the rear end thereof, there are provided an engaging portion 165 for restricting the back-and-forth movement of the water container 160 and a locking portion 166 for prohibiting the water container 160 from falling out of the recess 150.

Referring to FIG. 10, the recess 150 in which the water container 160 is received is recessed from the outer surface of the lower case 120 and is constructed so that the water container 160 may be suitably fitted. A catch hole 154, on which the hook portion 164 of the water container 160 can be hooked, is formed in front of the recess 150 on the lower case 120. Also, the front portion of the recess 150 is formed with a connection hole 151*a* for receiving the ejection nozzle 161 of the water container 160. The rear portion thereof is provided with a pressing protrusion 152, which is positioned so as to correspond to the pressure-applying member 162, for pressing the pressure-applying member 162. Also, a locking button 153, which is engaged to the locking portion 166 of the water container 160 to fixedly secure the water container 160 in the recess 150, is provided in the rear of the recess 150 on the lower case 120.

Accordingly, the water container 160 is positioned in the recess 150 with the ejection nozzle 161 fitted into the connection hole 151*a* and the pressure-applying member 162 contacted to the pressing protrusion 152. Also, there is provided a sealing member 151 between the connection hole 151*a* and the ejection nozzle 161 in order to seal the space of the connection hole 151*a* and the ejection nozzle 161. Therefore, the ejection nozzle 161 is engaged to the connection hole 151*a* by means of the sealing member 151.

Figure 12:
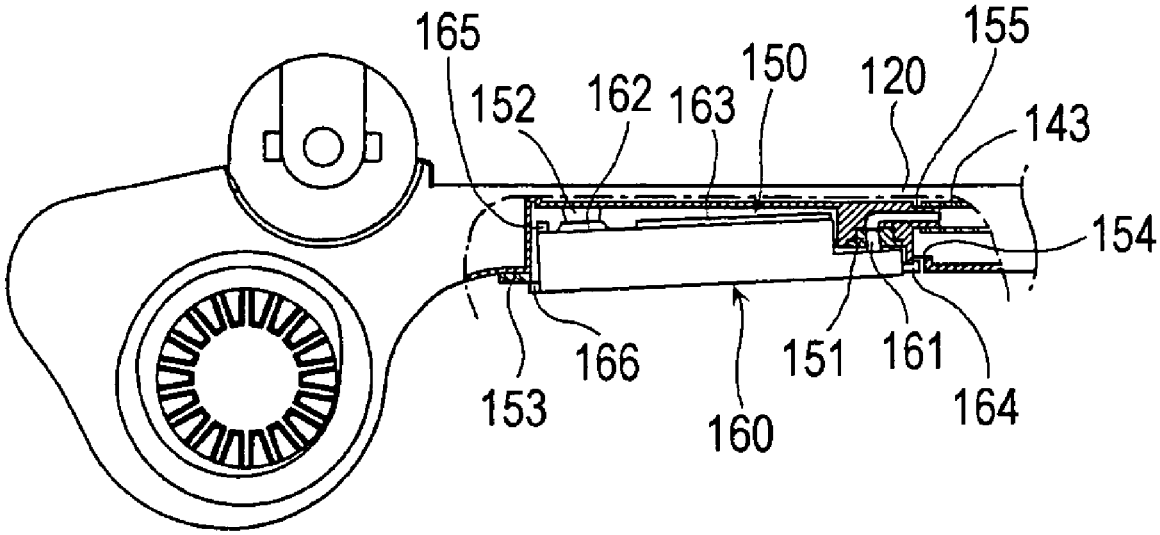
FIG. 12 is a partially cutaway side view of the lower case with the water container.

FIG. 12 is a partially cutaway side view of the lower case 120 with the water container 160 received in the recess 150. FIG. 12 shows that the water inside the water container 160 is ready to be supplied.

The water container 160 in the present embodiment is constructed so as to eject the stored water by means of the pumping action resulting from the pressure caused by the force of pressing down the water container 160. Such pumping action is performed by means of the interaction of the pressing protrusion 152 provided in the recess 150 and the pressure-applying member 162 provided in the water container 160.

The pressure-applying member 162 is made of silicone or rubber to have flexibility with which its shape can be altered by external pressure. Thus, in the state shown in FIG. 12, when the user presses down the water container 160 toward the recess 150, the pressing protrusion 152 counteractively presses the pressure-applying member 162. The pressure-applying member 162 pressed by the pressing protrusion 152 is pushed inside the water container 160, thereby raising the pressure inside the water container 160. Therefore, the water stored inside the water container 160 can be discharged from the ejection nozzle 161. That is, if the user presses down the water container 160 gradually toward the recess 150, the pumping action is performed and at the same time, a volume of the water stored in the water container 160 is discharged from the ejection nozzle 161. Subsequently, if the user removes the force applied to the water container 160, the pressure-applying member 162 recovers its original state with its flexibility and the water container 160 returns to its original position.

Referring to FIG. 12, the water container 160 is ready to supply water in an inclined state where the water container 160 is further separated from the recess 150 at the rear side than the front side. This is because the pressing protrusion 152 and the pressure-applying member 162 are in contact with each other and the pressure-applying member 162 is maintained in its original state. In such a case, the sealing member 151 interposed between the ejection nozzle 161 and the connection hole 151*a* is also made of silicone or rubber to allow the water container 160 to be maintained in an inclined state. Accordingly, the sealing member 151 not only seals the space between the connection hole 151*a* and the ejection nozzle 161, but also holds the water container 160 in the recess 150.

The water discharged from the water container 160 exits an outlet 155 formed in the recess and is supplied to the steam-generating plates 141 and 142 side through a connecting hose 143, which connects the recess 150 and the steam-generating plates 141 and 142 together. The connecting hose 143 is connected to the injection hole 142*b* of the second steam-generating plate 142. In such a case, in order to prevent the discharged water from flowing back inside the water container 160 when the water container 160 returns to its original position, it is preferred that means for preventing a back flow such as a check valve is provided.

Also, FIG. 12 shows the state wherein the water container 160 may be pressed down toward the recess 150 in order to supply the steam-generating plates 141 and 142 with water. In case of securing the water container 160, whose water is consumed, to the lower case 120, the water container 160 can be seated in the recess 150 by pushing the water container 160 into the recess 150 and engaging the locking button with the locking portion 166.

Figure 13:
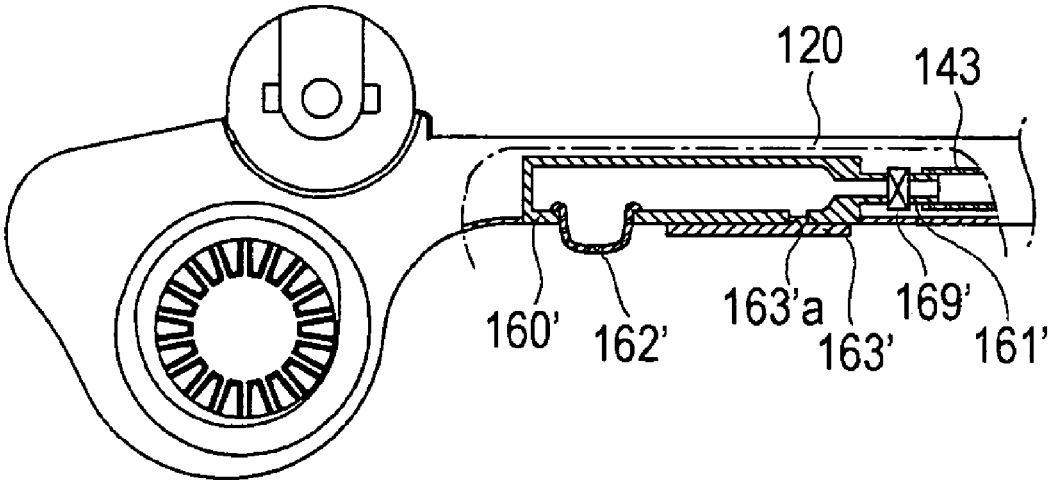
FIG. 13 is a partially cutaway side view of the lower case showing an alternative construction of the water container.

FIG. 13 is a partially cutaway side view of the lower case 120 showing an alternative construction of the water container 160. The water container 160' shown in FIG. 13 is integrally incorporated in the lower case 120. The water container 160' includes: a pressure-applying member 162' for causing the pumping action by applying pressure; a water inlet 163'*a*; and a lid 163' for covering and protecting the water inlet 163'*a*. The pressure-applying member 162' is made of silicone or rubber and has flexibility to cause the pumping action. This is so that the pressure-applying member 162' can be pressed down inside the water container 160' through the pressure applied by the user and recovers its original state without the user's press.

Also, a water outlet 161' from which water is discharged by the pumping action of the pressure-applying member 162' is provided in front of the water container 160'. Further, means for preventing a back flow such as a check valve is provided near the water outlet 161'. The pressure from the user raises the internal pressure of the water container 160'. Therefore, the water stored in the water container 160' is discharged from the water outlet 161' to be supplied to the steam-generating plates 141 and 142 via the connecting hose 143.

Figure 14:
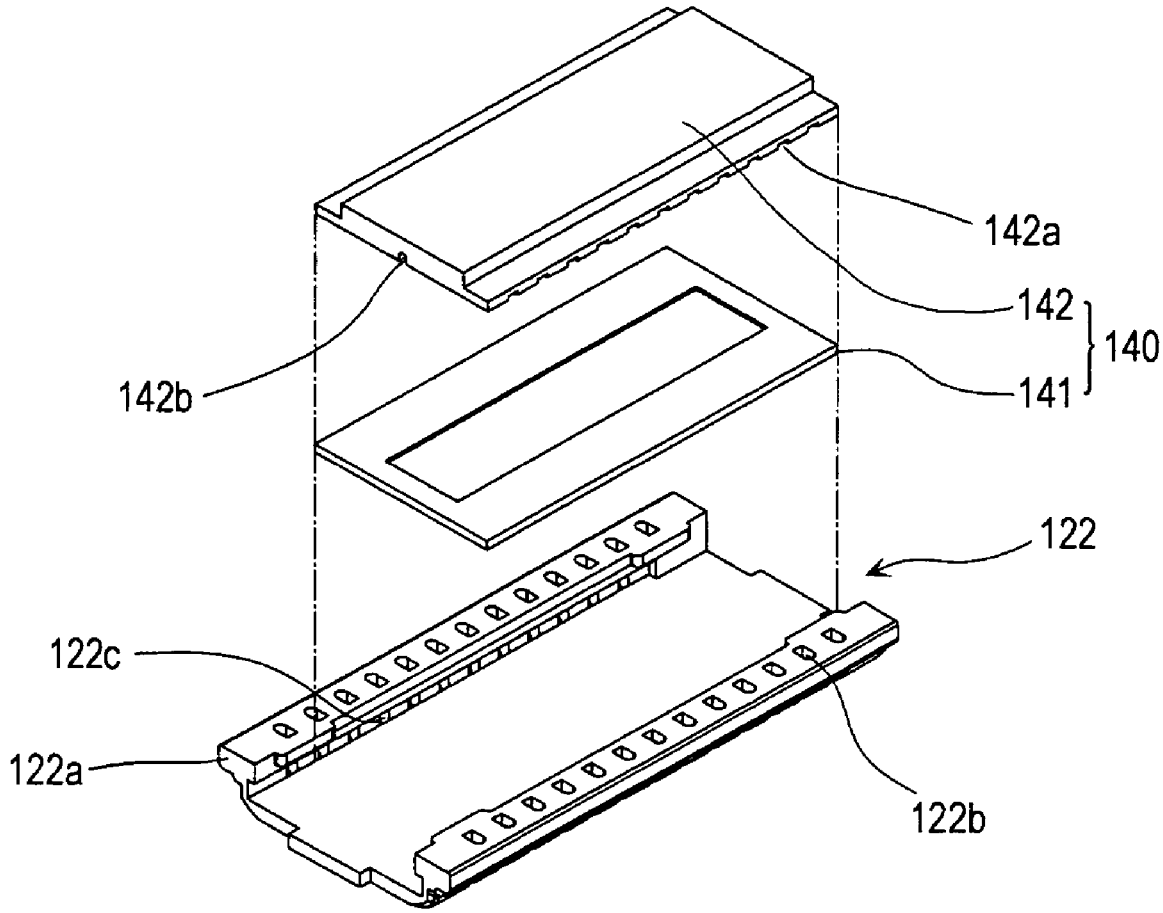
FIG. 14 is a perspective view showing a lower supporting member and means for providing moisture.

The steam-generating plates 141 and 142 for transforming the water supplied from the water container 160 into steam are shown in FIG. 14. The steam-generating plates 141 and 142 are arranged between the lower heater plate 121 and the lower supporting member 122 and transform the water into steam by means of the heat generated from the lower heater plate 121.

The steam-generating plates 141 and 142 comprise two heat-resistive and highly conductive plates, for example, a first steam-generating plate 141 and a second steam-generating plate 142. The central portions of the first steam-generating plate 141 and the second steam-generating plate 142 are formed concavely with respect to each other to define a cavity 144. The supplied water is introduced into the cavity 144 and then transformed into steam.

The steam transformed in the cavity 144 is ejected out of the second steam-generating plate 142 through a plurality of steam-ejecting holes formed in both side edges of the second steam-generating plate 142. Also, connecting holes 122*c* corresponding to the steam-ejecting holes 142*a*, which connect the steam-ejecting holes 142*a* with the air passages 127*a* and 127*b*, are formed in the side wall of the lower supporting member 122. Referring back to FIG. 7, the steam transformed in the cavity 144 is ejected from the steam-ejecting holes 142*a*, the connecting holes 122*c*, the air passages 127*a* and 127*b* and the air-ejecting holes 122*b*, and then supplied to the hair.

In this way, if necessary, the user can supply the hair with steam while the user styles the hair with the hair iron 100. Therefore, hair styling can be easier and hair can be kept healthier due to optimal moisturizing.

The hair iron 100, which is constructed in accordance with the preferred embodiment of the present invention, further comprises means for controlling the volume of air ejected from the air-ejecting holes 122*b*, which is engagable and removable between the lower heater plate 121 and the lower supporting member 122.

Figure 15A:
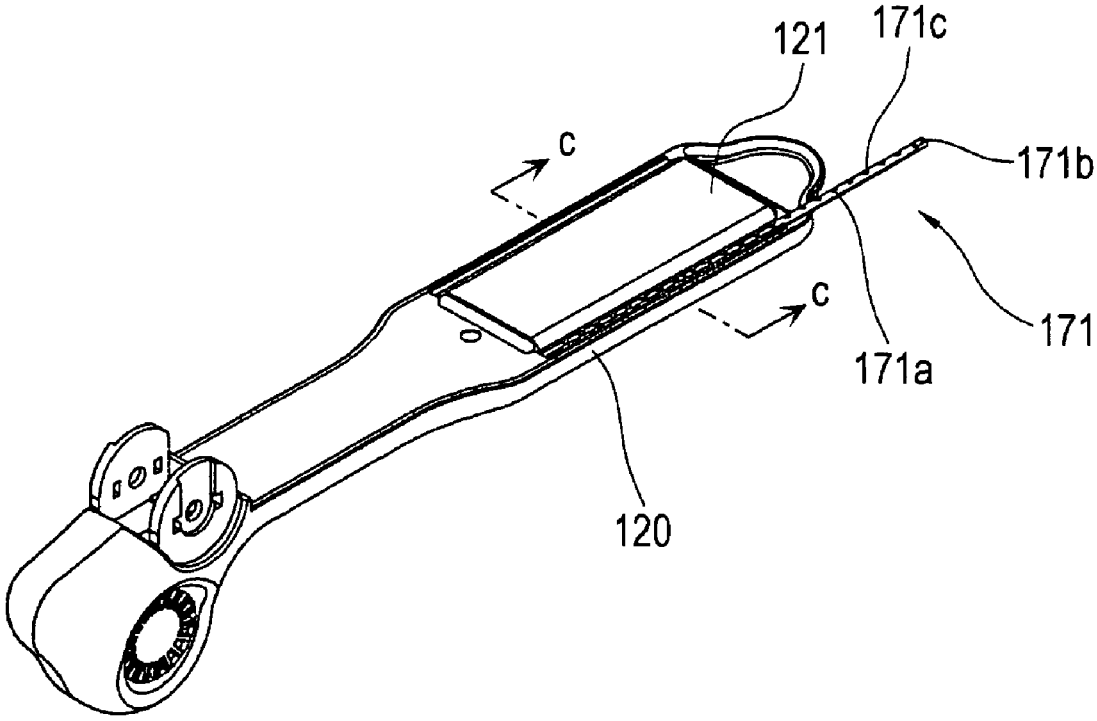
FIG. 15*a* is a perspective view showing one example of means for controlling the volume of air.
Figure 15B:
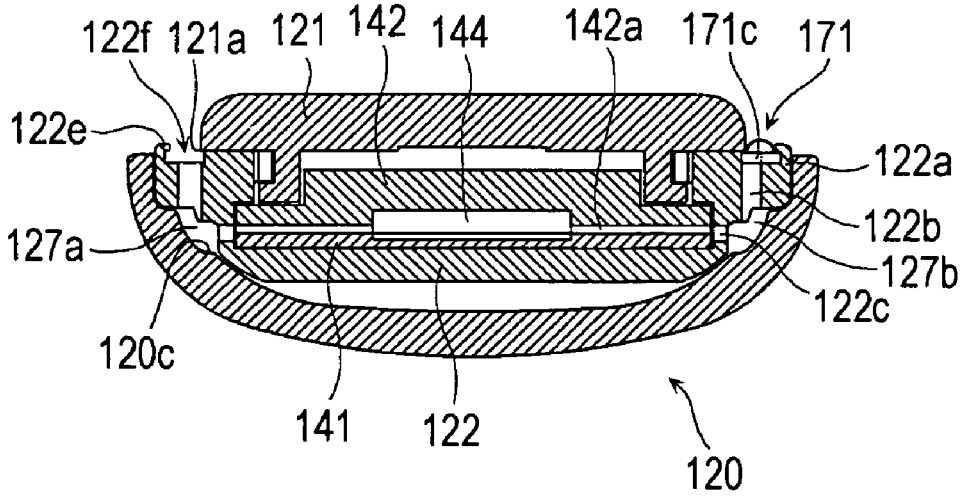
FIG. 15*b* is a cross-sectional view along the line C-C in FIG. 15*a*.
Figure 16A:
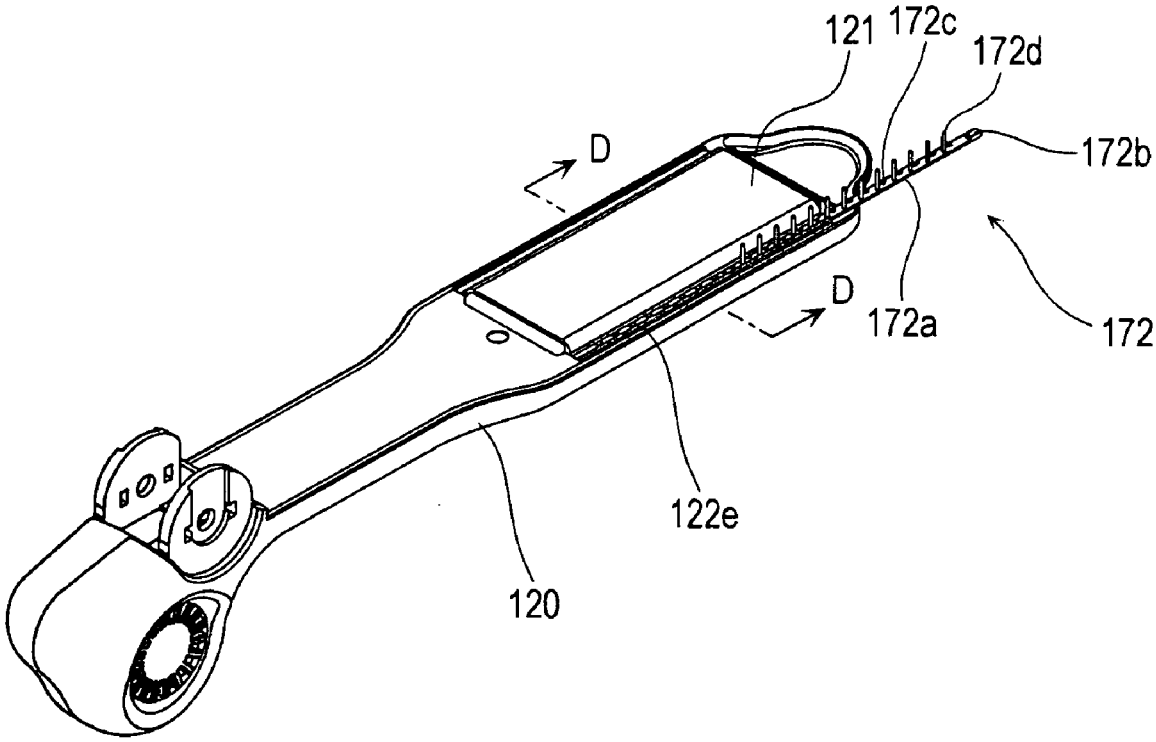
FIG. 16*a* is a perspective view showing another example of means for controlling the volume of air.
Figure 16B:
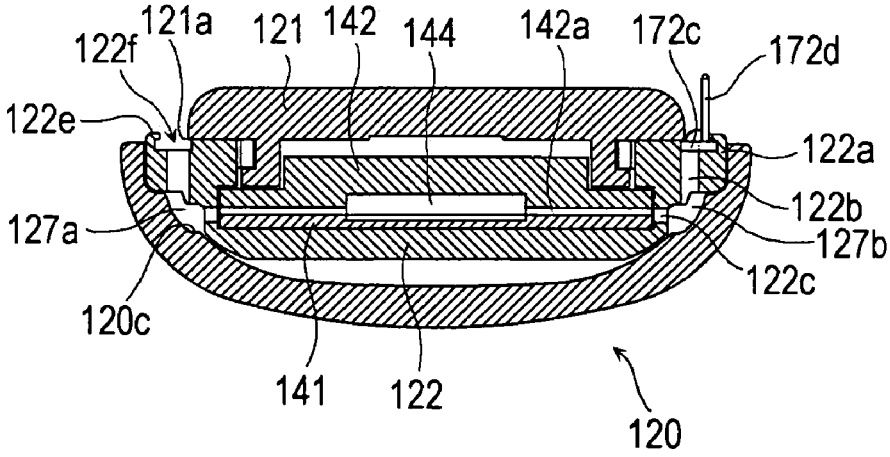
FIG. 16*b* is a cross-sectional view along the line D-D in FIG. 16*a*.

FIG. 15*a* is a perspective view showing one example of the controlling means 171 and FIG. 15*b* is a cross-sectional view along the line C-C in FIG. 15*a*. FIG. 16*a* is a perspective view showing another example of the controlling means 172 and FIG. 16*b* is a cross-sectional view along the line D-D in FIG. 16*a*.

The controlling means 171 includes: an elongated plate-like bar 171*a*; a handle projection 171*b* provided at one end of the bar 171*a* so as to be gripped by the user; and a plurality of air outlets 171*c* corresponding to the air-ejecting holes 122*b* of the lower supporting member 122. In such a case, if the air outlets 171*c* are formed differently and variously compared to the air-ejecting holes 122*b*, the user can choose the volume of air ejected from the air-ejecting holes 122*b*. Also, the controlling means 172 is formed with comb-teeth in addition to the construction of the controlling means 171.

Those controlling means 171 and 172 may be inserted between edges of the same side or respectively between edges of the both sides of the lower supporting member 122 and the lower heater plate 121. In order to receive the controlling means 171 and 172, the one side edge or both side edges of the lower supporting member 122 can be formed along the extended portion 122*a* with a hook-like holding portion 122*e* extended from the extended portion 122*a*. Further, the side edge 121*a* of the lower heater plate 121 is protruded slightly toward the holding portion 122*e* so as to hold the controlling means 171 in the opposite side in cooperation with the holding portion 122*e*. Accordingly, the controlling means 171 is engaged with or removed from the groove 122*f* defined by the holding portion 122*e*, the upper surface of the extended portion 122*a* and the side edge 121*a*.

Therefore, during hair styling, the user can more precisely choose the volume of air provided through the controlling means 171 and 172. Particularly, when the controlling means 172 is employed, the comb-teeth 172*d* can improve the shaping of the hair during hair styling. In such a case, since the air is forced by the fan 134, anions or steam is ejected from the air outlets 171*c* and 172*c* formed in the controlling means 171 and 172. Preferably, the length of the controlling means 171 and 172 is set so that the air-ejecting holes 122*b* and the air inlets 171*c* and 172*c* can be aligned with each other.

Figure 17:
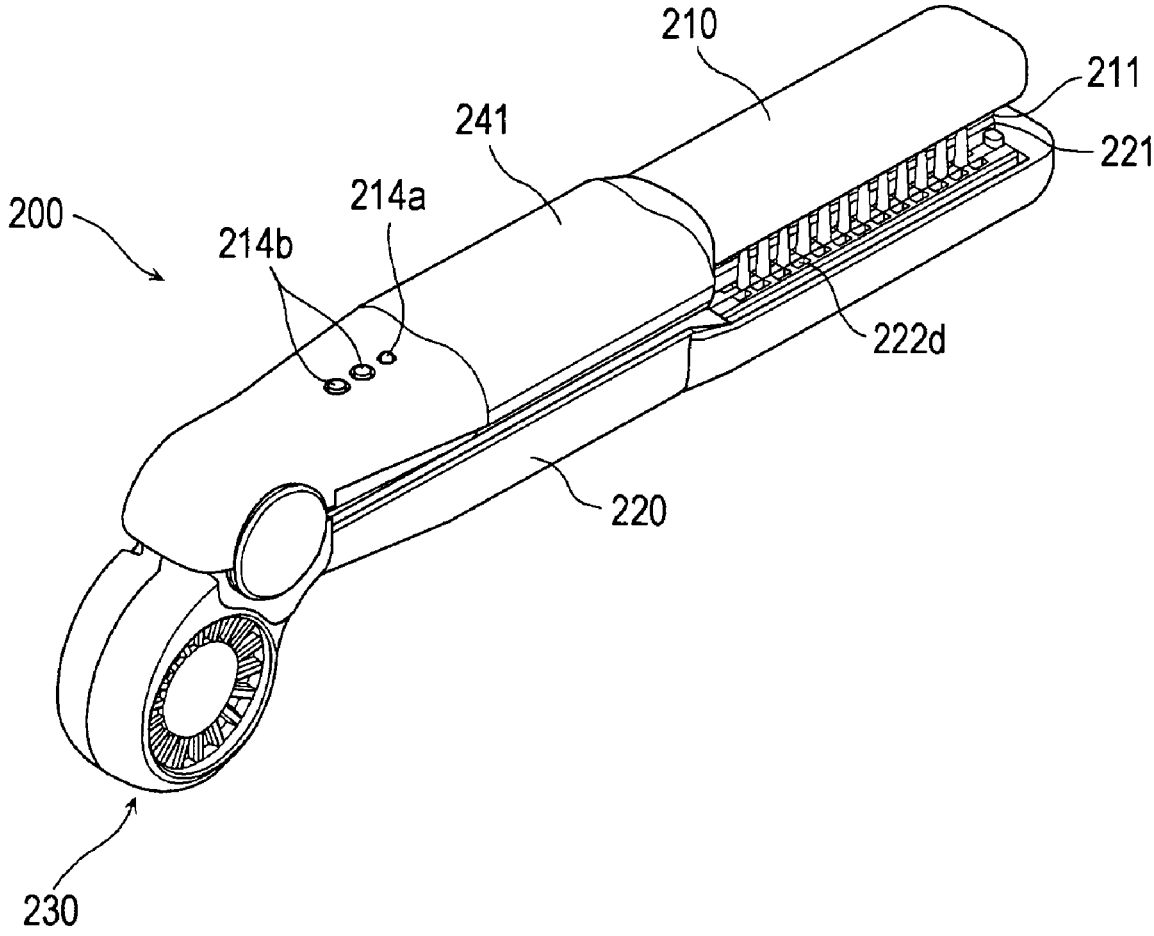
FIG. 17 is a perspective view illustrating a hair iron in accordance with another preferred embodiment of the present invention.
Figure 18:
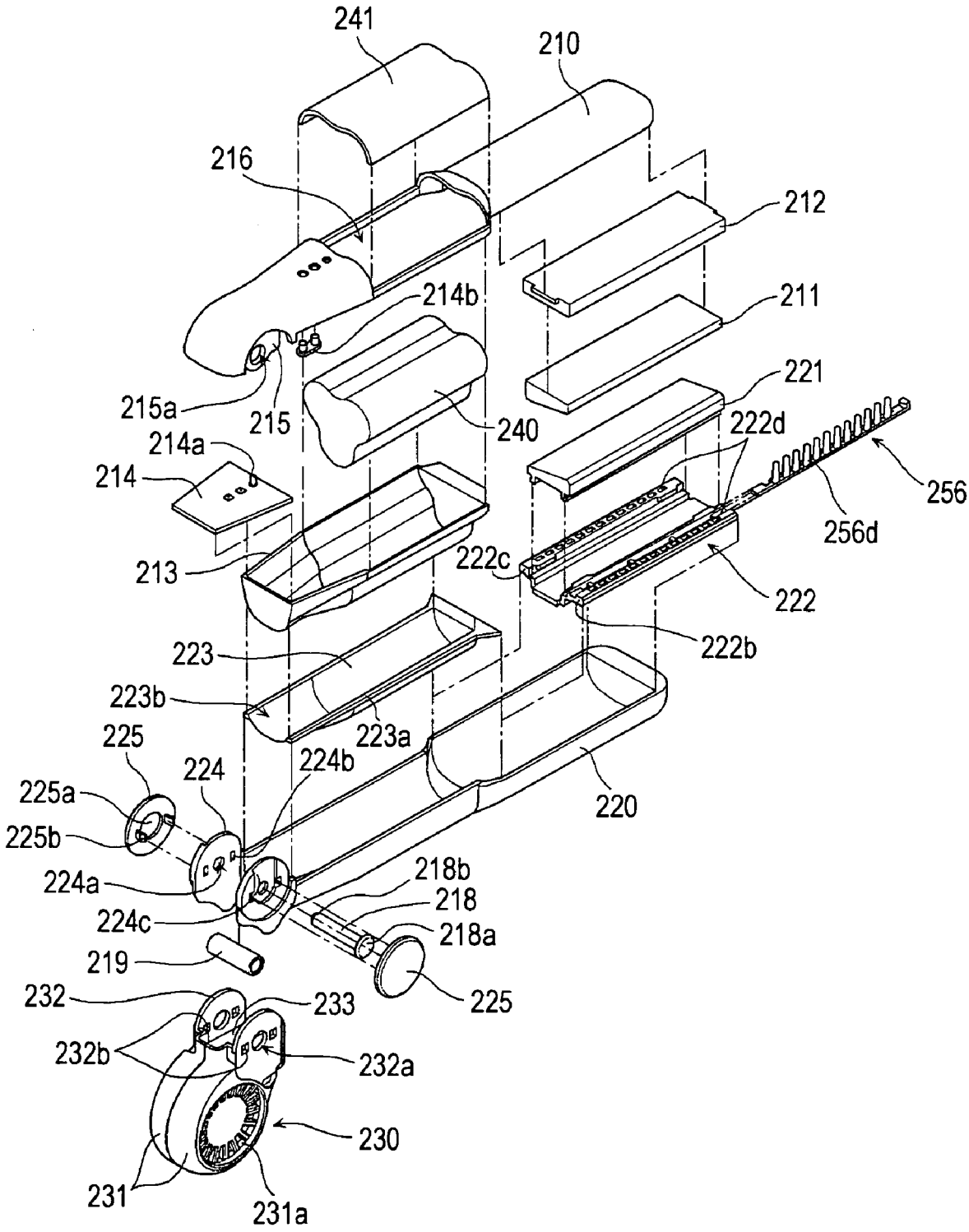
FIG. 18 is an exploded perspective view of the hair iron illustrated in FIG. 17.

FIG. 17 is a perspective view illustrating a hair iron 200, which is constructed in accordance with another preferred embodiment of the present invention. FIG. 18 is an exploded perspective view of the hair iron 200 illustrated in FIG. 17.

The hair iron 200 is constructed without a power cord so that the hair iron 200 can be always utilized without any spatial restriction.

The hair iron 200 comprises: a pair of cases 210 and 220 hinge-jointed at each one end and being freely opened or closed; heater plates 211 and 221 respectively mounted to the sides, which face each other, of the cases 210 and 220 for generating heat; a fan assembly 230 coupled to the end of one 220 of the cases for blowing air toward the heater plates; supporting members 212 and 222 formed with a plurality of air-ejecting holes 222*d*, each supporting member being disposed between one of the cases 210 and 220 and one of the heater plates 211 and 221 to support the heater plates 211 and 221; and an air passage 226 for transferring the air blown by the fan assembly 230 to the air-ejecting holes 222*d*. The fan assembly 230 may be coupled to the upper case 210. In such a case, the arrangement of the components related to an air blow, which is described later, may be altered accordingly.

The heater plates 211 and 221 for generating heat required to style the hair are mounted to the other ends of the upper case 210 and the lower case 220. In close proximity to the heater plate 221, there are provided the air-ejecting holes 222*d* from which the air blown from the fan assembly 230 is ejected, as well as means for controlling the volume of air 256. Also, at the middle of the upper case 210, and more specifically between the upper case 210 and the upper cover member 213, a battery holder 240 containing at least one battery/batteries for supplying the heater plates 211 and 221 and the fan assembly 230 with an electric power is equipped.

The width of a portion of the upper case 210, to which the heater plate 211 is mounted, is narrower than that of the lower case 220 to which the heater plate 221 is mounted. Accordingly, the air ejected from the air-ejecting holes 222*d* can be discharged smoothly. Also, the heater plates 211 and 221 contact each other throughout their entire surfaces. When the direction that the heater plates 211 and 221 are mounted to the cases 210 and 220 is a lengthwise direction, their contact surfaces are inclined widthwise. Accordingly, the contact area of the heater plates 211 and 221 becomes wider and a portion of hair to be styled is thus enhanced.

The upper case 210 has a receiving space opened toward the lower case 220. The upper heater plate 211, the upper supporting member 212, the upper cover member 213, a PCB 214 and the battery holder 240 are received in the receiving space. The upper case 210 makes a pair with the lower case 220 to be opened and closed about the hinge shaft 218 within a certain degree of angle.

The upper heater plate 211 making a pair with the lower heater plate 221 of the lower case 220 is mounted in the receiving space of the other end of the upper case 210. The heater plates 211 and 221 are provided with heaters, which are supplied with an electric power from the batteries to generate heat. The heaters may be a plate type, a coil type, etc.

The upper supporting member 212 is disposed between the upper case 210 and the upper heater plate 211. The upper supporting member 212 supports the heater plate 211 with respect to the upper case 210 so that the heater plate 211 becomes exposed externally by a constant elevation. The upper supporting member 212 also insulates the heat generated from the upper heater plate 111.

The upper cover member 213 is disposed between the one end of the upper case 210 and the upper supporting member 212. The upper cover member 213 is formed convexly toward the lower case 220 so as to receive the battery holder 240 and hides the receiving space of the upper case 210 uncovered by the upper supporting member 212. The battery holder 240 and the PCB 214 are disposed between the upper cover member 213 and the upper case 210.

The battery holder 240 has at least one battery (not shown). The battery supplies electric power to the heater plates 211 and 221, a blowing fan (not shown) and various elements mounted on the PCB 214. Although not shown in the drawings, the battery should be electrically connected to the heater plates, the blowing fan and the various elements mounted on the PCB.

Figure 26:
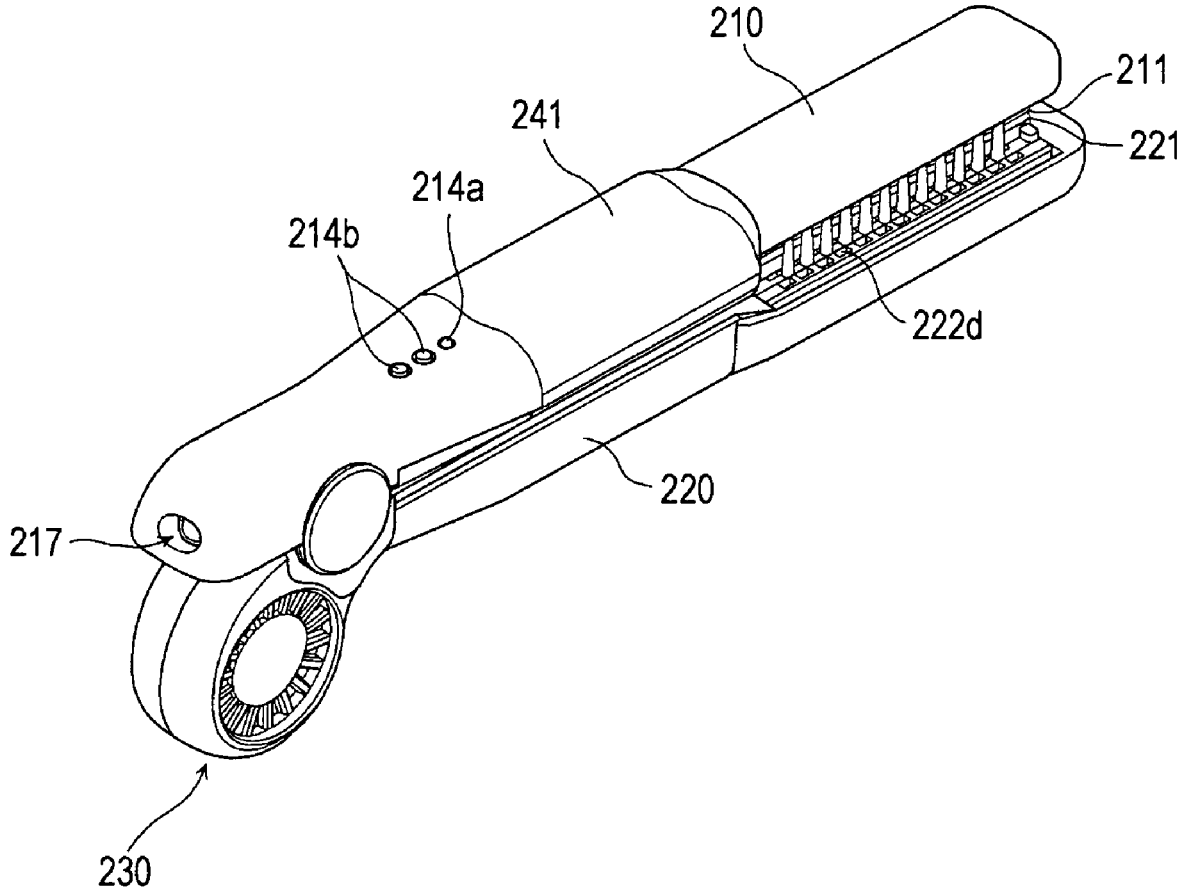
FIG. 26 is a perspective view of the hair iron illustrated in FIG. 17 having a jack.

As to the battery contained in the battery holder 240, a dry cell or a rechargeable battery may be employed. Further, as shown in FIG. 26, when the one end of the upper case 210 is provided with a jack 217, the hair iron 200 can be operated by means of an external power source with the output terminal of an external adaptor connected to the jack 217. In case the battery holder 240 with a rechargeable battery is used, the rechargeable battery can be charged using the jack 217. That is, a circuit for charging the rechargeable battery may be constructed inside or outside the hair iron 200.

Elements (not shown) for controlling the operation of the hair iron 200, switches 214*b*, and LEDs 214*a* for indicating the operating states are mounted on the PCB 214. In such a case, the PCB 214 is positioned in the upper case 210 and the upper cover member 213 so that the switches 214*b* and the LEDs 214*a* may be exposed to the outside and be operated from the outside.

The middle portion of the upper case 210 is formed with an opening 216 through which the battery holder 240 is inserted into a space formed between the upper case 210 and the upper cover member 213 or removed therefrom. Also, a battery cover 241 is provided in the upper case 210 so as to open and close the opening 216. In this case, a locking device capable of maintaining the closed state of the battery cover 241 may be provided in the upper case 210.

In order to be joined to the lower case 220 and the fan assembly 230, two plate-like hinge portions 215 are extended from the one end of the upper case 210 toward the lower case 220. Each hinge portion 215 is formed with a through-hole 215*a* into which an oil-less bearing 219 is fitted. The hinge portions 215 are located inside the outer surface of the upper case 210. Therefore, although the upper case 210, the lower case 220 and the fan assembly 230 are joined together, the lateral sides of the hair iron 200 do not protrude out much.

The fan assembly 230 includes: a housing 231 with air inlets 231*a*; and a blowing fan (not shown) contained in the housing 231 and made as an individual product having a motor. One side of the housing 231 is integrally formed with shaft-supporting portions 232 engaged to the hinge portions 215 of the upper case 210 and the hinge portions 224 of the lower case 220.

The central portion of each shaft-supporting portion 232 is formed with a through-hole 232*a* for allowing the hinge shaft 218 to be inserted therethrough. Catch holes 232*b*, in which the hooks 225*b* are caught, are formed adjacent to the through-hole 232*a*. In such a case, it is natural that the catch holes 232*b* are located in alignment with the through-holes 224*b* of the hinge portion 224.

A guide plate 223 is formed between the shaft-supporting portions 232. The guide plate 223 does not hinder the engagement of the hinge shaft 218 and the oil-less bearing 219 and guides the blown air, as well as isolating the blown air from the outside. Accordingly, the blown air is prevented from leaking from a space other than the air passage 226, that is, a space formed among the upper case 210, the lower case 220 and the fan assembly 230.

Further, the fan assembly 230 may include an anion generator, which is described in connection with the fan assembly 130. In such a case, the hair iron 200 can cure or improve the damaged hair, improve the moisturizing state of the hair and prevent the crumbliness of the hair.

The lower case 220, which makes a pair with the upper case 210 and is joined to the upper case 210 and the fan assembly 230, has a receiving space opened toward the upper case 230.

The lower heater plate 221, the lower supporting member 222 and the lower cover member 223 are mounted in the receiving space, whereby the air passage 226 through which the blown air passes is formed.

The one end of the lower case 220 is formed with hinge portions 224 extended toward the upper case 210. Each hinge portion 224 is formed with a through-hole 224*a* into which the hinge shaft 218 is fitted and two through-holes 224*b* through which the hooks 225*b* of the hinge cap 225 are passed adjacent to the through-hole 224*a*.

After the hinge portions 224 of the lower case 220 are located outside the shaft-supporting portions 232 of the fan assembly 230 and when the oil-less bearing 219 is fitted into the hinge portions 215, the hinge portions 215 are located between the shaft-supporting portions 232 and the hinge shaft 218 passes through the through-holes 215*a*, 232*a* and 224*a* in sequence to be engaged with the oil-less bearing 219. This is so that the upper case 210, the lower case 220 and the fan assembly 230 can contribute to the construction of the hair iron 200.

In such a case, the hinge shaft 218 has a diameter sufficient to be inserted inside the oil-less bearing 219. Also, the hinge shaft 218 has at one end a head portion 218*a* having a diameter larger than that of the through-hole 224*a* of the hinge portion 224. At the other end, there is provided a groove 218*b* in which an E-shaped snap ring (not shown) can be fastened so as not to be removed after engagement.

Since a groove 224*c* is formed centrally outside each hinge portion 224 in order to receive the head portion 218*a* and the E-shaped snap ring, the hinge cap 225 can be attached to the outer surface of the hinge portion 224, irrespective of the engagement of the hinge shaft 218. Particularly, since a groove 225*a* is formed on the inner surface of the hinge cap 225 in order to receive the head portion 218*a* and the E-shaped snap ring, the width of the hair iron 200 can be mitigated.

As described above, the diameters of the through-holes 215*a*, 232*a* and 224*a* differ from each other, and the diameters and lengths of the hinge shaft 218 and the oil-less bearing 219 are also different. Further, the oil-less bearing 219 is engaged with the through-holes 215*a* and the hinge shaft 218 is engaged with the through-holes 224*a* and 232*a* and the oil less bearing 219. Thus, the upper case 210 and the lower case 220 are allowed to be freely opened and closed within a certain degree of angle with a minimum amount of friction.

The lower cover member 223 is engaged with the lower case 220 between the one end of the lower case 220 and the lower supporting member 222. The lower cover member 223 is formed with a recessed portion 223*b*, which is concave toward the lower case 220 so as to receive the convex configuration of the upper cover member 213. Also, the lower cover member 223 is formed along its side edges with extended portions 223*a* cooperating with the inner wall of the lower case 220 to define the air passage 226 for the blown air to pass through. The extended portion 223*a* is formed to substantially block the lower case 220 when the lower cover member 223 is engaged to the lower case 220.

In the present embodiment, the upper and lower cover members 213 and 223 are made independently and are engaged with their respective cases 210 and 220. However, the cover members are integrally incorporated in the cases. In such a case, the air passage may be formed accordingly.

Figure 19:
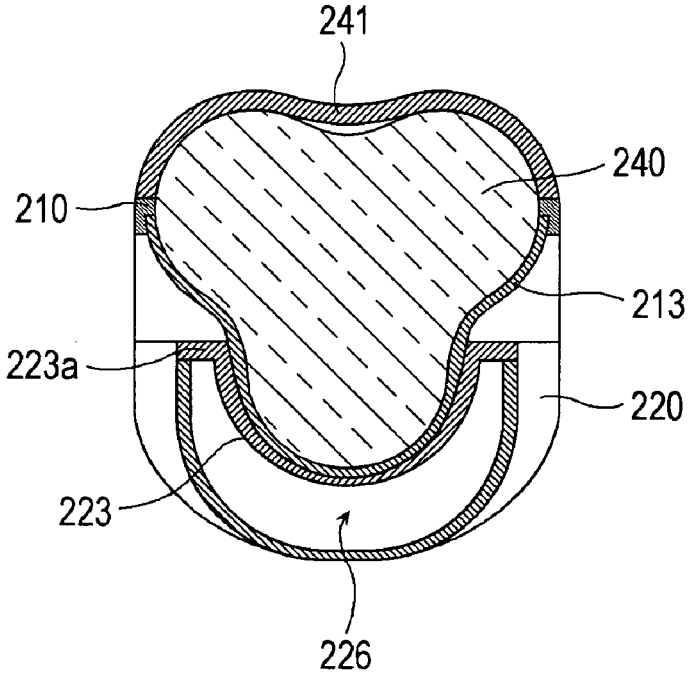
FIG. 19 is a cross-sectional view showing the closed state of an upper case and a lower case illustrated in FIG. 17.

Referring to FIG. 19, which shows the closed state of the upper case 210 and the lower case 220, since the lower portion of the upper cover member 213 is received in the recessed portion 223*b* of the lower cover member 223, the total height of the hair iron 220 can be mitigated.

The lower supporting member 222 for holding the lower heater plate 221, which generates heat required to style the hair, is engaged to the other end of the lower case 220. The outer wall of the lower supporting member 222 is also separated from the inner wall of the lower case 220 to define the other part of the air passage 226.

Figure 20:
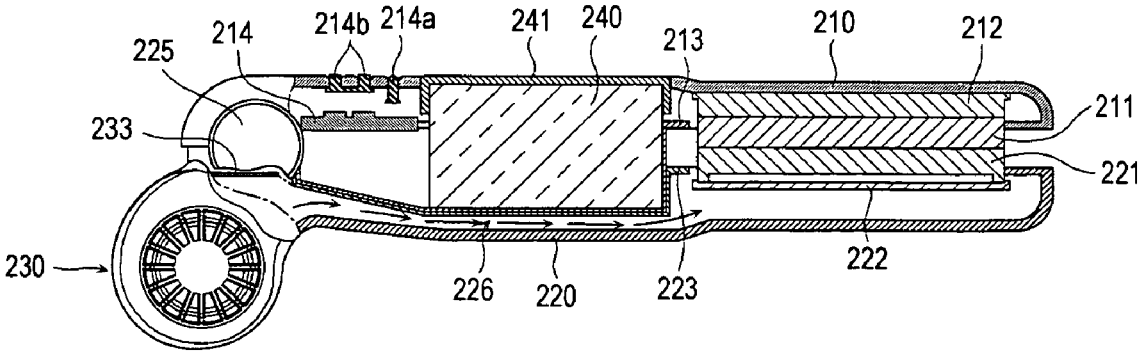
FIG. 20 is a longitudinal-sectional view of the hair iron in FIG. 17.

The above-mentioned air passage 226 is shown more clearly in FIG. 20. One part of the air passage 226 is defined by the inner wall of the lower case 220 and the outer wall of the lower cover member 223. Also, the other part of the air passage 226 is defined by the inner wall of the lower case 220 and the outer wall of the lower supporting member 222. The arrows shown in FIG. 20 indicate the flow of the blown air. Air, which is taken in from the exterior and blown by the fan assembly 230, is transferred to the user's hair or scalp through one part of the air passage 226 between the lower case 220 and the lower cover member 223, the other part of the air passage between the lower case 220 and the lower supporting member 222, and the air-ejecting holes 222*d* formed in the lower supporting member 222 after being discharged from the fan assembly 230.

Moreover, as seen clearly in FIG. 20, in the hair iron 200 constructed in accordance with the present embodiment, the user can use the hair iron 200 portably without any spatial restriction since electric power is supplied from the batteries contained in the battery holder 240 of the upper case 210. Further, the user can style the hair in various fashions because the hair iron 200 optionally provides the heat from the heater plates 211 and 221 and the air from the fan assembly 230.

Figure 21:
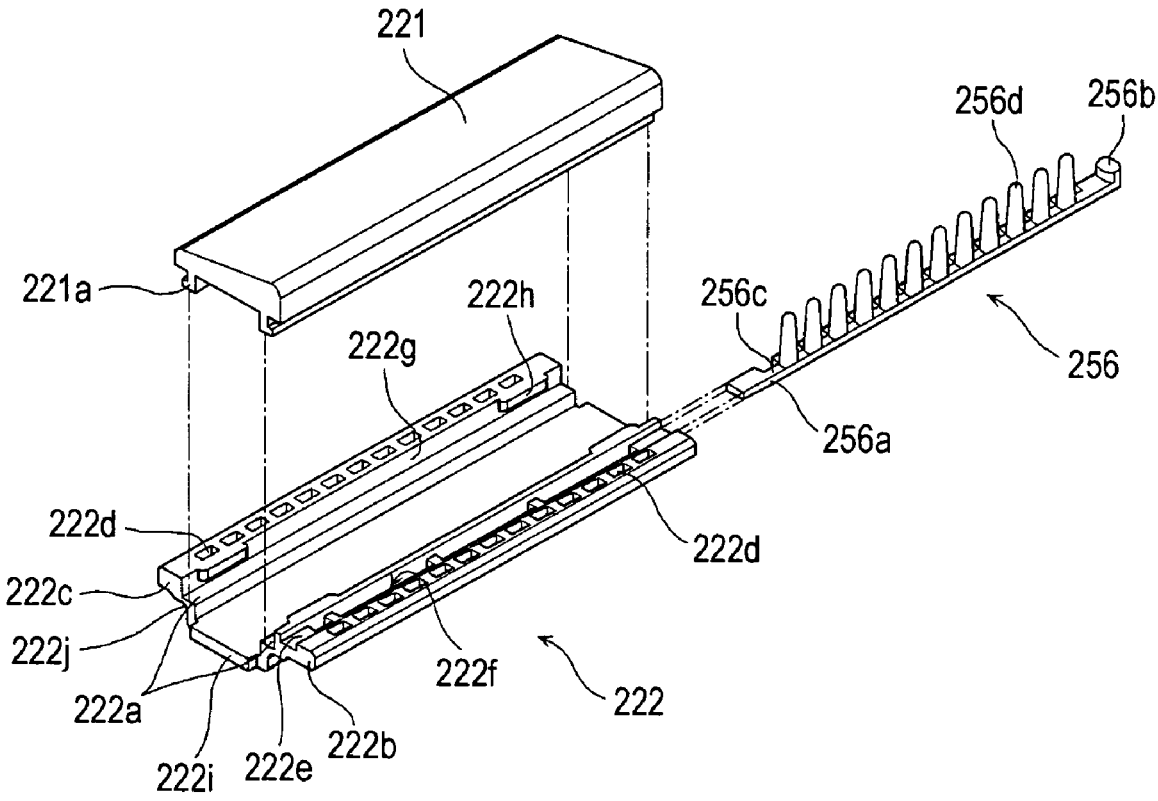
FIG. 21 is an enlarged perspective view of a supporting member, a heater plate and means for controlling the volume of air.

FIG. 21 is an enlarged perspective view of the lower supporting member 222, the lower heater plate 221 and one example 256 of means for controlling the volume of air, which are shown in FIG. 18.

The lower supporting member 222 has the shape in which both of the long sides of a rectangular plate are alternatively bent twice. More specifically, each of the opposed long edges of the lower supporting member 222 is formed with a supporting portion 222*a* alternatively bent twice. Further, extended portions 222*b* and 222*c* are formed in the respective supporting portions 222*a* to abut against the inner wall of the lower case 220. Each of the extended portions 222*b* and 222*c* is formed with a plurality of the air-ejecting holes 222*d* from which the blown air is ejected.

The outer surfaces 222*j* of the supporting portions 222*a* and the extended portions 222*b* and 222*c* are formed so as to be concave with respect to the inner wall of the lower case 220, which allows the air passage 226 to be defined between the inner wall of the lower case 220 and the outer wall of the lower supporting member 222 when the lower supporting member 222 is engaged to the lower case 220.

Each inner surface 222*g* of the extended portions 222*b* and 222*c* is formed with a protruding portion 222*h* with which a rail-like coupling protrusion 221*a*, which is formed on the lower surface of the lower heater plate 221, are engaged. Accordingly, the lower heater plate 221 is held on the lower supporting member 222 while the coupling protrusion 221*a* of the lower heater plate 221 is fitted between the supporting portion 222*a* and the protruding portion 222*h*.

A fixing protrusion 222*i* fixes the lower supporting member 222 to the lower case 220 when the lower supporting member 222 is engaged to the lower case 220.

Further, the lower supporting member 222 is configured so that the user can choose the volume of air discharged from the lower supporting member 222 depending on the user's selection. That is, since the lower supporting member 222 is provided with means for controlling the volume of air 251 to 256, which helps the user choose the volume of air, the user can control the volume of air. To this end, the extended portion 222*b* is formed with a fixing groove 222*e* for the controlling means 251 to 256 to be fitted into and the fixing groove 222*e* is formed with additional air-discharging holes 222*f* in order to discharge the blown air transferred through the air passage.

The controlling means 251 to 256 are fitted into the fixing groove 222*e* to block, partially open or fully open the air-discharging holes 222*f*. Consequently, the volume of air discharged from the lower supporting member 222 can be increased depending on the user's selection based on the volume of air ejected from the air-ejecting holes 222*d*. If necessary, the fixing groove 222*e* may be formed in the opposite extended portion 222*c*.

Figure 22:
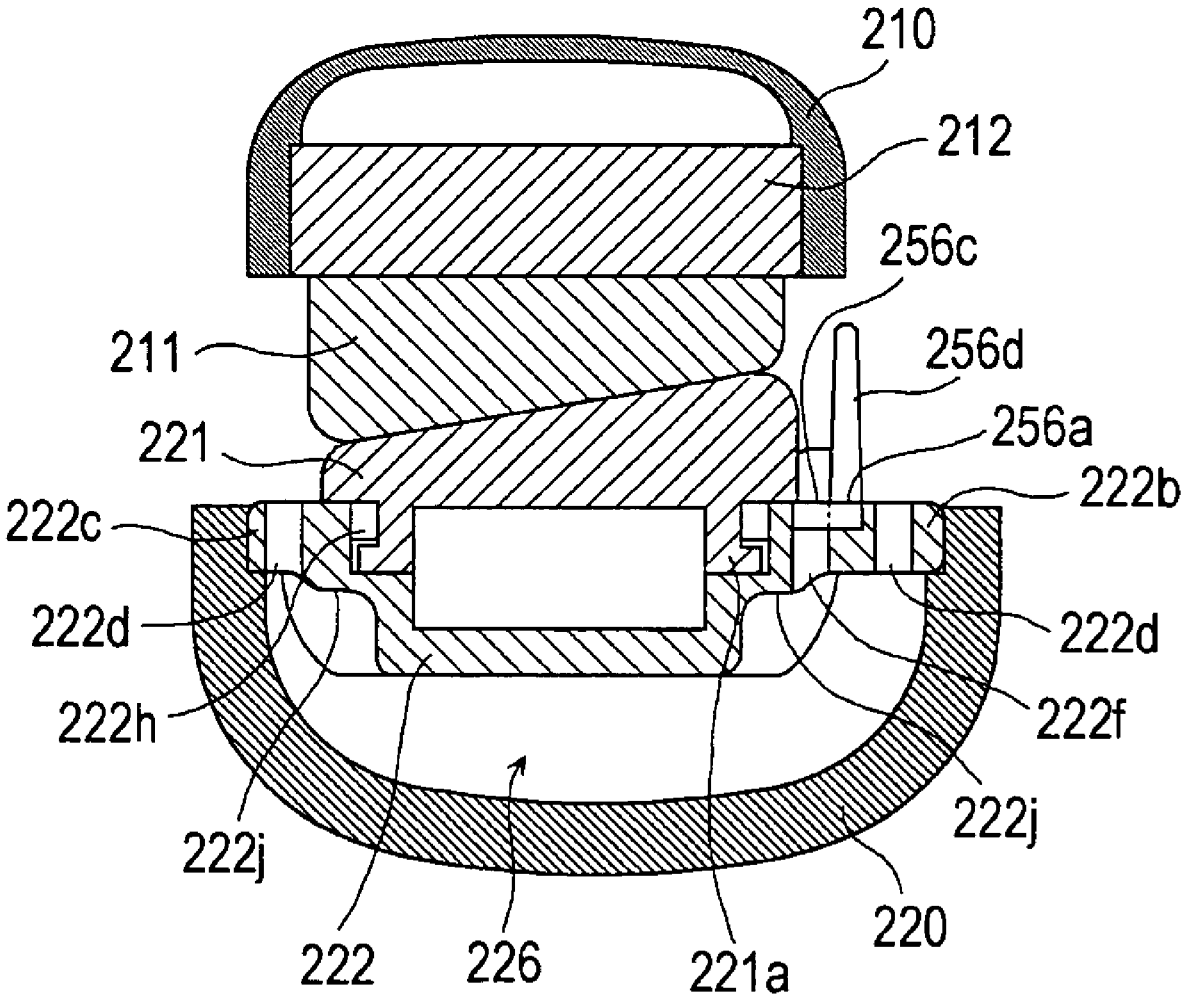
FIG. 22 is a cross-sectional view showing the closed state of the hair iron illustrated in FIG. 17.

As shown in FIG. 22, the air, which is transferred forcedly through the air passage 226 defined by the inner wall of the lower case 220 and the outer wall of the lower supporting member 222, is discharged outward through the air-discharging holes 222*f* of the fixing groove 222*e* and the air outlets 256*c* formed in the controlling means 256, while being discharged outward through the air-ejecting holes 222*d* of the lower supporting member 222.

Further, when the hair iron 200 constructed in accordance with the present embodiment includes a different means for opening and closing in the air passage 256 side or the air-ejecting holes 222*d* side, the hair iron 200 may be constructed to discharge air from one or both sides of the lower supporting member 222.

FIGS. 23*a* to 23*f* are perspective views of various examples of the controlling means. FIG. 24 is a perspective view showing the engagement and removal of the controlling means. FIGS. 25*a* to 25*f* are cross-sectional views showing the air flows and correspond to FIGS. 23*a* to 23*f*, respectively.

Figure 23A:
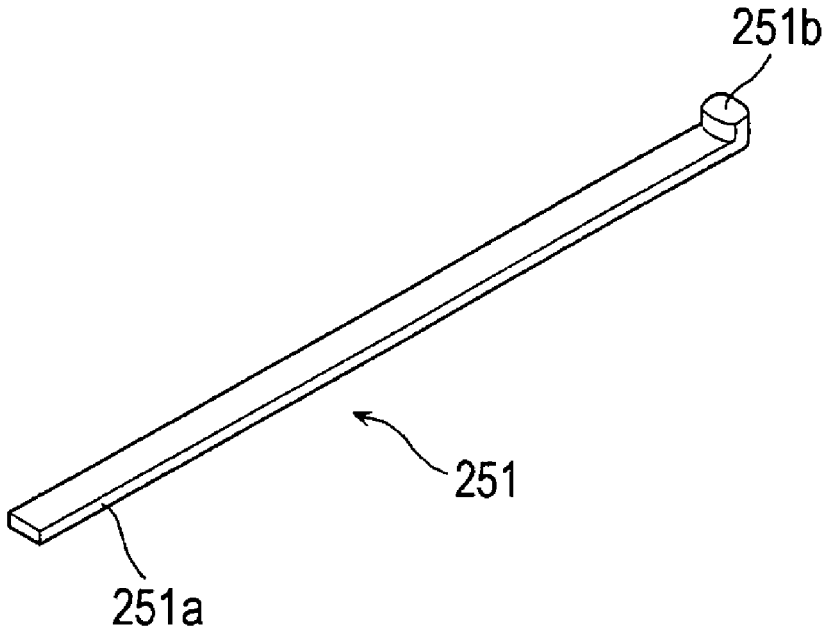
FIGS. 23*a* to 23*f* are perspective views of various examples of the controlling means.
Figure 24:
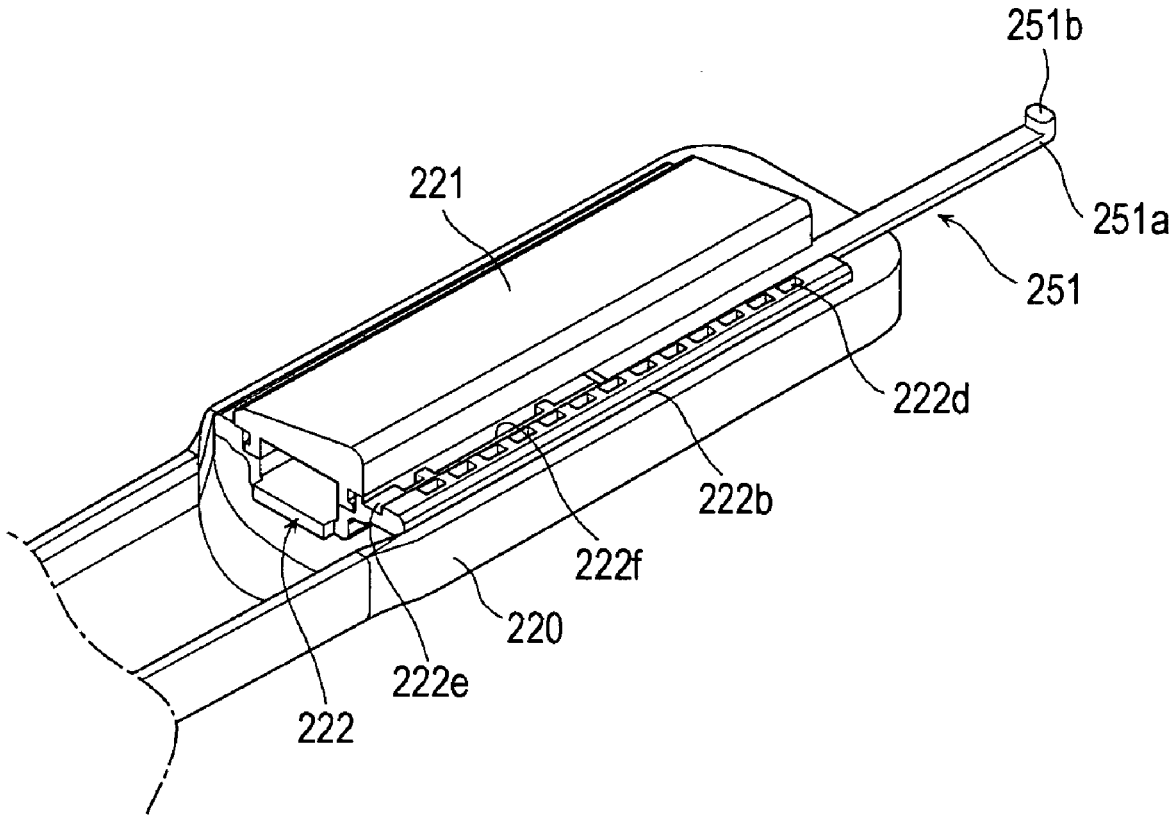
FIG. 24 is a perspective view showing the engagement and removal of the controlling means.

Referring to FIG. 23*a*, the controlling means 251 includes: an elongated plate-like bar 251*a*; and a handle projection 251*b* provided in one side of the bar 251*b*. As shown in FIG. 24, the controlling means 251 is fitted into the fixing groove 222*e* of the lower supporting member 222. The user can fit the controlling means 251 into the fixing groove 222*e* or remove it therefrom using the handle projection 251*b*. Thus, it is preferred that the width of the bar 251*a* is set so as to be equal to the width of the fixing groove 222*e*. Also, the side 221*b* of the lower heater plate 221 seated on the lower supporting member 222 is extended slightly and further toward the fixing groove 222*e*, which ensures that the controlling means 251 is seated in the fixing groove 222*e*. The bar and the handle projection are common components among the controlling means 252 to 256, as will be described hereinafter.

Figure 25A:
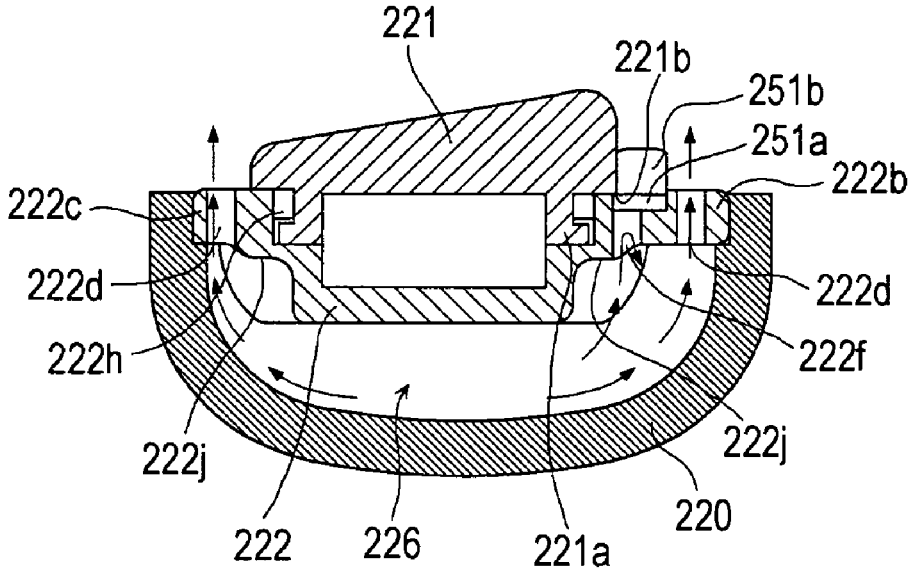
FIGS. 25*a* to 25*f* are cross-sectional views showing air flows, each corresponding to FIGS. 23*a* to 23*f*, respectively.
Figure 25B:
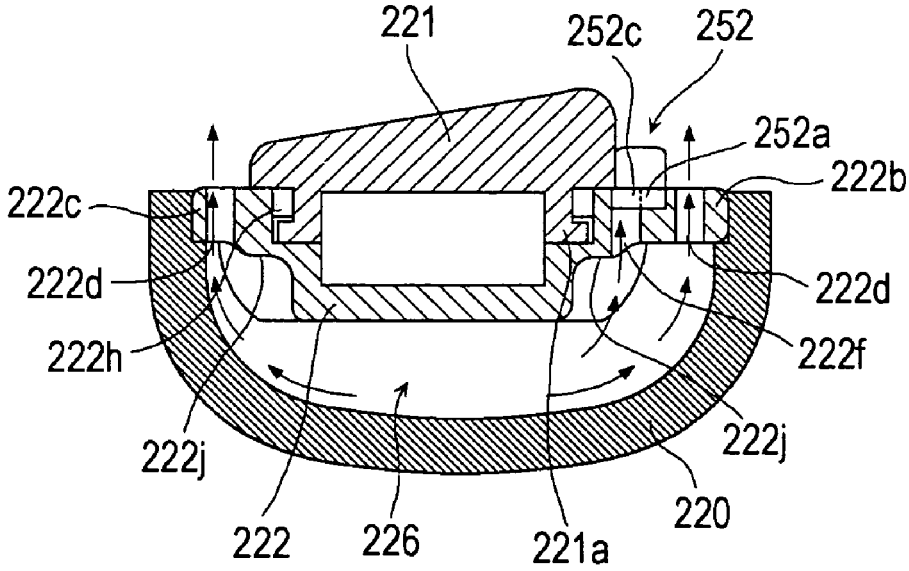
Figure 25C:
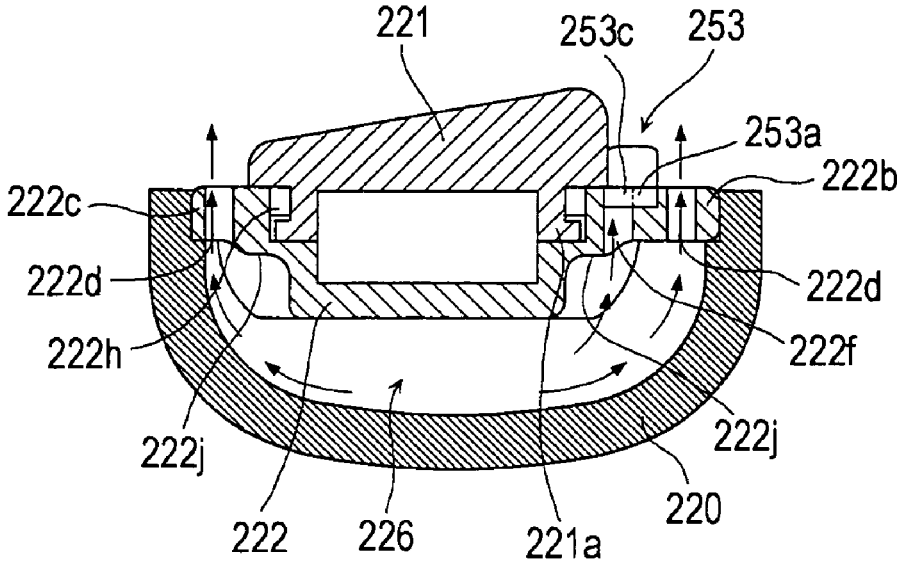
Figure 25D:
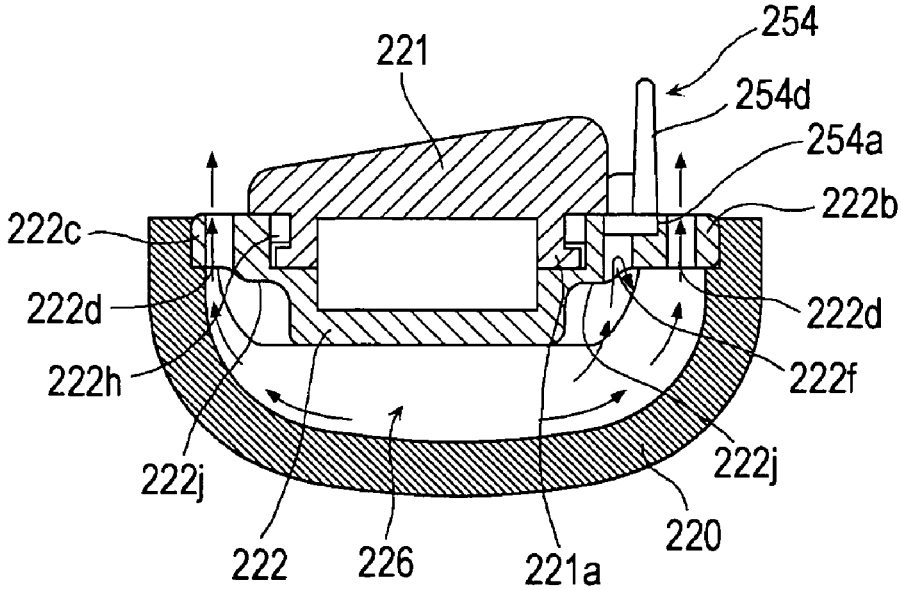
Figure 25E:
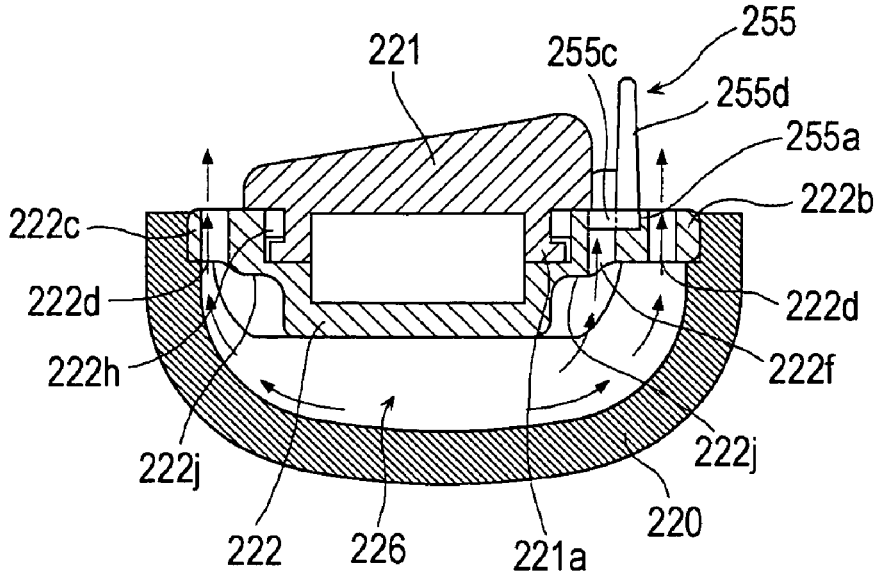
Figure 25F:
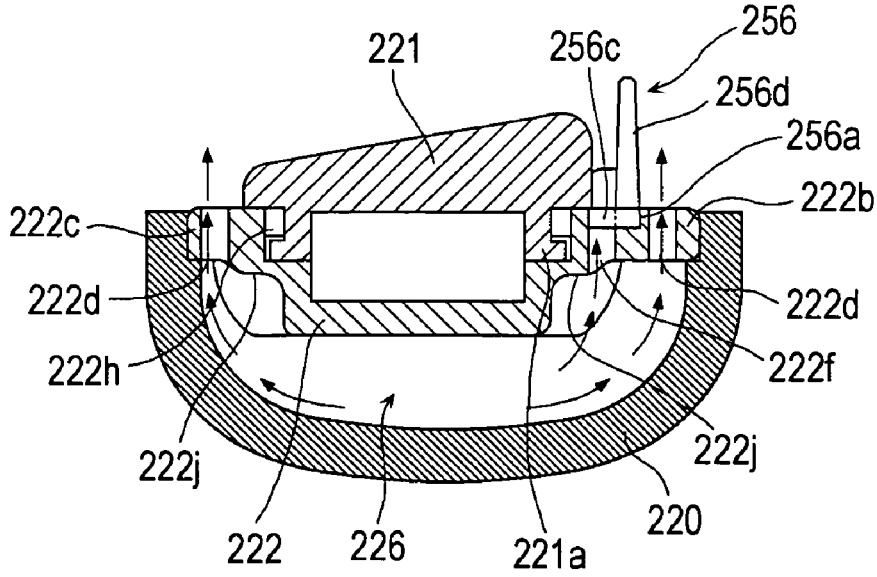

When the bar 251*a* part of the controlling means 251 is fitted into the fixing groove 222*e*, the air-discharging holes 222*f* are closed fully. As shown in FIG. 25*a*, since the blown air can be discharged only from the air-ejecting holes 222*d*, the volume of air discharged from the lower supporting member 222 is limited to the volume of air ejected from the air-ejecting holes 222*d*. Accordingly, the user can use only the heat generated from the heater plates 211 and 221 and the air ejected from the air-ejecting holes 222*d*.

Figure 23B:
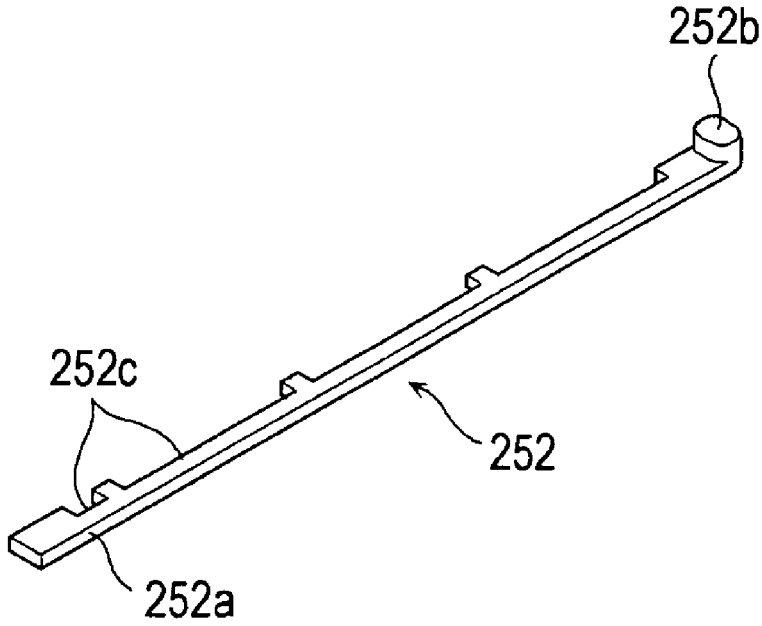

Referring to FIG. 23*b*, the controlling means 252 includes: an elongated plate-like bar 252*a*; a handle projection 252*b* provided in the one side of the bar 252*a*; and air outlets 252*c* formed so as to communicate with the air-discharging holes 222*f*. Preferably, the air outlets 252*c* are formed so as to have the same size as the air-discharging holes 222*f* of the fixing groove 222*e* and be aligned with the air-discharging holes 222*f* when the controlling means 252 is fitted into the fixing groove 222*e*. Thus, when the controlling means 252 is fitted into the fixing groove 222*e*, the air transferred through the air passage 226 is discharged outward through the air-ejecting holes 222*d* and the air outlets 252*c*. In such a case, the volume of air discharged from the lower supporting member 222 is maximized.

Figure 23C:
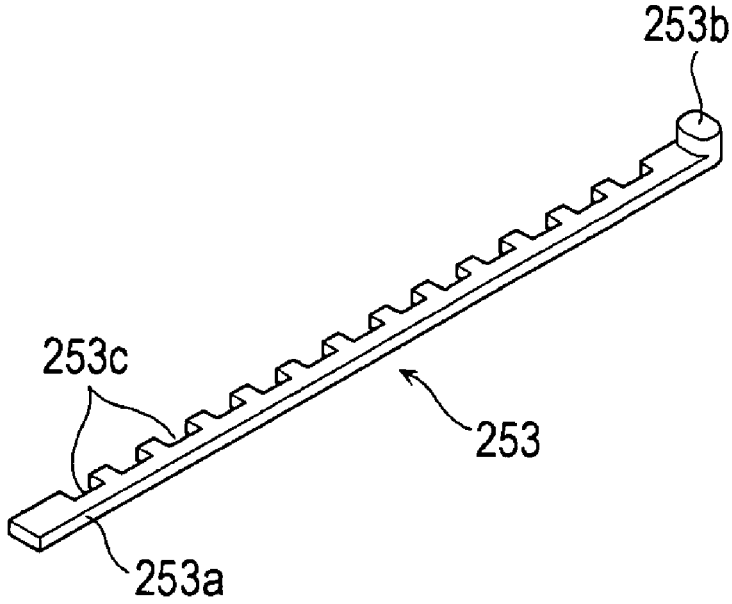

Referring to FIG. 23*c*, the controlling means 253 includes: an elongated plate-like bar 253*a*; a handle projection 253*b* provided in the one side of the bar 253*a*; and air outlets 253*c* formed so as to communicate with the air-discharging holes 222*f*. The air outlet 253*c* is formed so as to be smaller than the air-discharging hole 222*f*. Thus, when the controlling means 253 is fitted into the fixing groove 222*e*, the air transferred through the air passage 226 is discharged outward from the air-ejecting holes 222*d* and the air outlets 253*c*. In such a case, since a portion of the bar 253*a* between the air outlets 253*c* covers a part of the air-discharging holes 222*f*, the volume of air discharged from the lower supporting member 222 is decreased in comparison to the case that the controlling means 252 is employed.

Figure 23D:
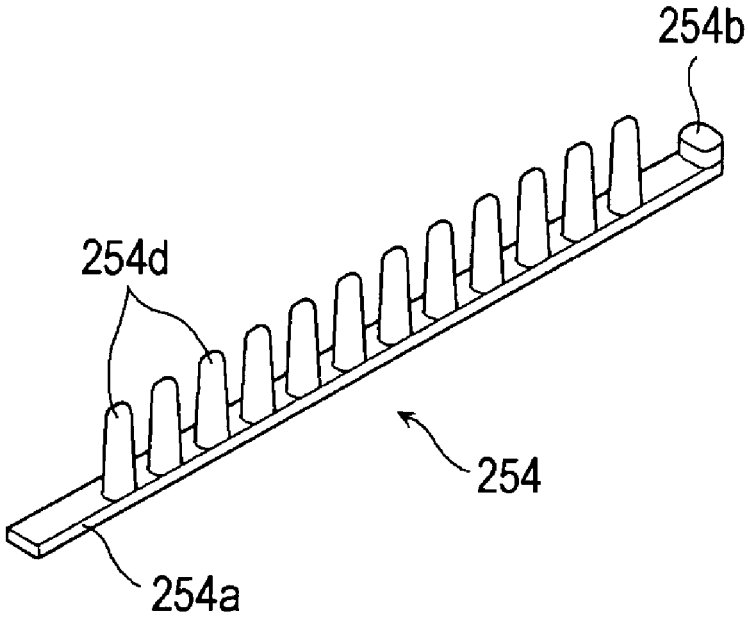

Referring to FIG. 23*d*, the controlling means 254 has the shape of the controlling means 251 and further includes a plurality of comb-teeth 254*d* formed along a bar 254*a*. When the controlling means 254 is fitted into the fixing groove 222*e*, the hair iron 200 not only has the function of the controlling means 251, but also enhances the shaping of hair by means of the comb-teeth 254*d*.

Figure 23E:
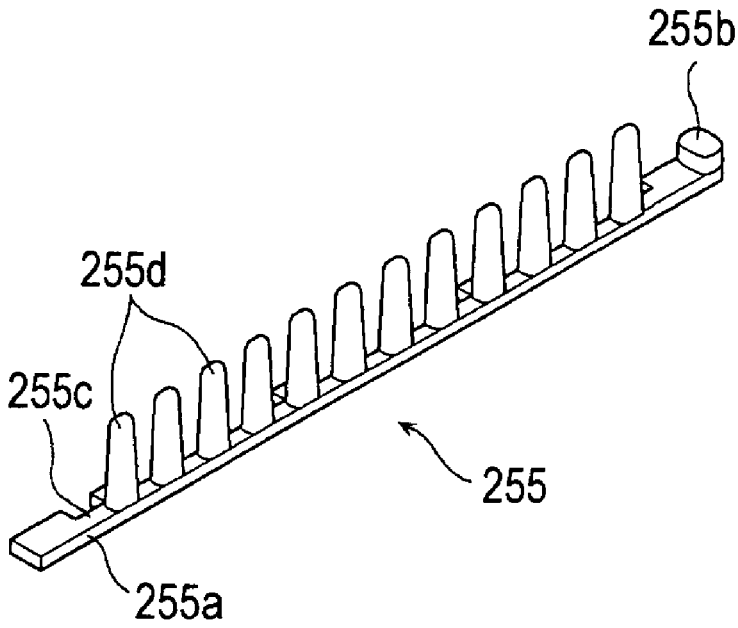

Referring to FIG. 23*e*, the controlling means 255 has the shape of the controlling means 252 and further includes a plurality of comb-teeth 255*d* formed along a bar 255*a*. When the controlling means 255 is fitted into the fixing groove 222*e*, the volume of air discharged from the lower supporting member 222 is maximized and the shaping of the hair is enhanced.

Figure 23F:
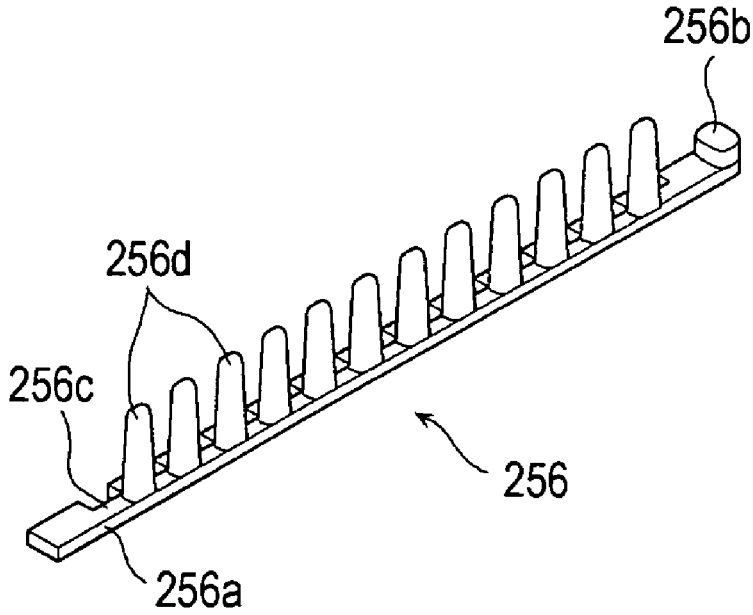

Referring to FIG. 23*f*, the controlling means 256 has the shape of the controlling means 253 and further includes a plurality of comb-teeth 256*d* formed along a bar 256*a*. When the controlling means 256 is fitted into the fixing groove 222*e*, since a part of the air-discharging holes 222*f* is blocked by a portion of the bar 256*a* between the air outlets 256*c*, the volume of air discharged from the lower supporting member 222 is decreased in comparison to the case wherein controlling means 255 is employed.

While the hair iron 200 in accordance with the present embodiment is constructed so that the user can choose the desired volume of air by means of the controlling means 251 to 256 based on the volume of air ejected from the air-ejecting holes 222*d*, the hair iron 200 constructed in accordance with the present embodiment is not limited thereto. Similar to the hair iron 100, it will be appreciated that the volume of air may be controlled through varying the rotating speed of the blowing fan or opening and closing the air passage 226.

Further, in addition to the controlling means illustrated above, it will be appreciated that the volume of air discharged from the lower supporting member 222 may be variously chosen through employing the controlling means designed to provide the air outlets of various sizes and numbers.

According to the hair irons of the preferred embodiments described above, air, anions or steam can be supplied to the hair during hair styling.

In case of blowing air to hair, the time required to dry the hair can be shortened when using the hair iron to dry the hair. Further, the problem in which the hair can be damaged due to the heat applied heavily to the hair during hair styling can be avoided.

Further, since the anions generated by the anion generator is supplied to the hair by being mixed with the air being transferred, the damaged hair can be cured or improved and hair can be given a moisturizing effect to ensure the health of the hair.

Further, since moisture can be provided to the hair during hair styling, the process for styling the hair into desired styles can be easier and faster. In addition, the moisture provided to the hair can provide the moisturizing effect and keep the hair healthier.

Further, since the hair iron is provided with a member having comb-teeth, the shaping of the hair can be enhanced during hair styling.

Further, since the hair iron having the above-mentioned functions comprises a battery holder containing batteries and can be operated by means of the batteries, the hair iron is constructed without a power cord and can be utilized without any spatial restriction.

Particularly, when the rechargeable batteries are employed as the batteries, there is no need to exchange the batteries with new ones due to exhaustion of the batteries. This enhances the portability of the hair iron all the more.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A hair iron, comprising:

an upper case and a lower case hinge-jointed at each one end thereof and being freely opened or closed;

an upper heater plate for generating heat and a lower heater plate for generating heat, each of the heater plates mounted to the sides facing each other of the upper and lower cases adjacent to the other end of each of the upper and lower cases, respectively;

a fan assembly for blowing air toward the lower heater plate, the fan assembly including a housing coupled to the hinge-jointed one end of the lower case opposite to the lower heater plate, the housing having air inlets through which external air flows in and two air outlets, the fan assembly having a fan contained inside the housing;

an upper supporting member for supporting and fixing the upper heater plate and a lower supporting member for supporting and fixing the lower heater plate, the upper supporting member being disposed between the upper case and the upper heater plate, the lower supporting member being disposed between the lower case having both side edges and the lower heater plate, wherein the lower supporting member is formed along both side edges thereof with a plurality of air-ejecting holes;

an upper cover member engaged with the upper case between the upper supporting member and the hinge-jointed one end of the upper case and a lower cover member engaged at both side edges thereof with the lower case between the lower supporting member and the hinge-jointed one end of the lower case, the upper cover member covering an inside of the upper case uncovered by the upper supporting member, the lower cover member covering an inside of the lower case uncovered by the lower supporting member;

two air passages for transferring the air blown from the fan assembly to the air-ejecting holes, one of the two air passages being in communication with one of the two air outlets at one end thereof and being in communication with the air-ejecting holes of one of the both side edges of the lower supporting member at the other end thereof, the other of the two air passages being in communication with the other of the two air outlets at one end thereof and being in communication with the air-ejecting holes of the other of the both side edges of the lower supporting member at the other end thereof, each of the air passages being constructed in the form of grooves formed continuously along one of the both sides of the lower case, wherein one part of the one of the two air passages is formed by one of the both side edges of the lower case and one of the both side edges of the lower cover member and the other part of the one of the two air passages is formed by the one of the both side edges of the lower case and one of the both side edges of the lower supporting member, wherein one part of the other of the two air passages is formed by the other of the both side edges of the lower case and the other of the both side edges of the lower cover member and the other part of the other of the two air passages is formed by the other of the both side edges of the lower case and the other of the both side edges of the lower supporting member; and two means for opening and closing the air passage, one of the two opening and closing means mounted to the lower cover member adjacent to one of both side edges of the lower case, the other of the two opening and closing means mounted to the lower cover member adjacent to the other of both side edges of the lower case, wherein the opening and closing means includes a blocking plate configured to block the air passage and a lever for turning the blocking plate, and wherein when one of the air passages is closed by the blocking plate, the air is supplied toward the lower heater plate only through the other of the air passages and is ejected only from the air-ejecting holes being in communication with the other of the air passages.

2. The hair iron as recited in claim 1, wherein the hair iron further comprises means for controlling the volume of air ejected from the air-ejecting holes of the lower supporting member, the controlling means being removably engaged to the lower supporting member.

3. The hair iron as recited in claim 2, wherein the controlling means includes a first bar closing the air-ejecting holes and at least one second bar having air outlets communicating with the air-ejecting holes.

4. The hair iron as recited in claim 3, wherein the number and sizes of the second bars are different from each other.

5. The hair iron as recited in claim 3, wherein the first bar and the second bar have a plurality of comb-teeth.

6. The hair iron as recited in claim 1, wherein the hair iron further comprises means for providing hair with moisture and means for supplying the moisture-providing means with water.

7. The hair iron as recited in claim 6, wherein the moisture-providing means includes a steam-generating plate disposed between the lower heater plate and the lower supporting member, and wherein steam-ejecting holes are formed in both side edges of the steam-generating plate so as to communicate with the air passages.

8. The hair iron as recited in claim 6, wherein the water-supplying means includes a water container having a nozzle for ejecting the stored water, the water-supplying means further including a pressure-applying member for applying pressure to the stored water so as to discharge the stored water.

9. The hair iron as recited in claim 8, wherein the pressure-applying member is fabricated from silicone.

10. The hair iron as recited in claim 8, wherein a recess for receiving the water container is formed on the outer surface of the lower case, and wherein a connection hole into which the nozzle is fitted, a sealing member for sealing the nozzle and the connection hole, and a pressing protrusion for pressing down the pressure-applying member are formed in the recess, whereby when the water container is received in the recess and the water container is pressed toward the lower case, the pressing protrusion presses down the pressure-applying member so that the water inside the water container is ejected.

11. The hair iron as recited in claim 10, wherein the sealing member is fabricated from silicone.

* * * * *

UNITED STATES PATENT AND TRADEMARK OFFICE

CERTIFICATE OF CORRECTION

PATENT NO. : 7,465,904 B2
APPLICATION NO. : 11/263205
DATED : December 16, 2008
INVENTOR(S) : Tai Cheul Kim It is certified that error appears in the above-identified patent and that said Letters Patent is hereby corrected as shown below:

On the title page item (75), remove Hyun Jin Kim as an inventor

Signed and Sealed this

Twenty-eighth Day of July, 2009

John Doll

JOHN DOLL
*Acting Director of the United States Patent and Trademark Office*